United States Patent [19]

Spendel

[11] Patent Number: 4,555,019

[45] **Date of Patent: * Nov. 26, 1985**

[54] PACKAGED DETERGENT COMPOSITION WITH INSTRUCTIONS FOR USE IN A LAUNDERING PROCESS

[75] Inventor: Wolfgang U. Spendel, Cincinnati, Ohio

[73] Assignee: The Procter & Gamble Company, Cincinnati, Ohio

[ * ] Notice: The portion of the term of this patent subsequent to Dec. 25, 2001 has been disclaimed.

[21] Appl. No.: 623,809

[22] Filed: Jun. 22, 1984

Related U.S. Application Data

[60] Division of Ser. No. 548,265, Nov. 3, 1983, Pat. No. 4,489,455, which is a continuation-in-part of Ser. No. 436,169, Oct. 28, 1982, Pat. No. 4,489,574, which is a continuation-in-part of Ser. No. 320,155, Nov. 10, 1981, abandoned.

[51] Int. Cl.[4] ..... B65D 85/00

[52] U.S. Cl. ..... 206/223; 206/0.5

[58] Field of Search ..... 68/16, 19.2, 20, 23.5, 68/58, 59, 148, 158, 159, 205 R, 207; 8/158, 159; 252/90, 93; 206/223, 0.5

[56] References Cited

U.S. PATENT DOCUMENTS

| | | |
|---|---|---|
| 872,097 | 11/1907 | Buggenhoudt . |
| 1,711,162 | 4/1929 | Woelfel . |
| 2,070,210 | 2/1937 | Mason . |
| 2,088,674 | 8/1937 | Whitehead . |
| 2,131,137 | 9/1938 | Franz . |
| 2,133,584 | 10/1938 | Spanel . |
| 2,257,716 | 9/1941 | Kauffmann . |
| 2,447,848 | 8/1948 | Edwards . |
| 2,915,890 | 12/1959 | McEwen . |
| 2,960,383 | 11/1960 | Potter . |
| 2,970,882 | 2/1961 | Kumin . |
| 2,983,568 | 5/1961 | Nerney . |
| 3,002,287 | 10/1961 | Smith . |
| 3,039,285 | 6/1962 | Smith . |
| 3,066,522 | 12/1962 | Steinmuller . |
| 3,104,152 | 9/1963 | McMackin . |
| 3,180,037 | 4/1965 | Kenreich . |
| 3,256,720 | 6/1966 | Green . |
| 3,265,462 | 8/1966 | Rogers . |
| 3,387,310 | 6/1968 | Marshall . |
| 3,388,410 | 6/1968 | Marshall . |
| 3,401,052 | 9/1968 | Berger et al. . |
| 3,402,576 | 9/1968 | Krupsky . |
| 3,416,879 | 12/1968 | Sookne . |
| 3,476,505 | 11/1969 | Kirner . |
| 3,505,004 | 4/1970 | Pfeil . |
| 3,595,036 | 7/1971 | DePas . |
| 3,611,456 | 10/1971 | Hildebrandt . |
| 3,647,354 | 3/1972 | Loeb . |
| 3,650,673 | 3/1972 | Ehner . |
| 3,663,975 | 5/1972 | Fish . |
| 3,707,856 | 1/1973 | Niewyk . |
| 3,722,234 | 3/1973 | Douglas . |
| 3,762,866 | 10/1973 | Rayment et al. . |
| 3,765,834 | 10/1973 | Sitver . |
| 3,807,950 | 4/1974 | Rogers . |
| 3,811,300 | 5/1974 | Barton et al. . |
| 4,024,735 | 5/1977 | Marchiselli . |
| 4,110,075 | 8/1978 | Graf . |
| 4,118,189 | 10/1978 | Reinwald . |
| 4,188,807 | 2/1980 | Graf et al. . |
| 4,270,282 | 6/1981 | Lotz . |
| 4,314,804 | 2/1982 | Gennekels . |
| 4,344,198 | 8/1982 | Arendt et al. ..... 8/158 |
| 4,432,111 | 2/1984 | Hoffmann et al. ..... 8/158 |

FOREIGN PATENT DOCUMENTS

| | | |
|---|---|---|
| 0043122 | 1/1982 | European Pat. Off. . |
| 8104418 | 8/1982 | Netherlands . |
| 1143921 | 2/1969 | United Kingdom . |
| 1509315 | 5/1978 | United Kingdom . |
| 2051883 | 1/1981 | United Kingdom . |

*Primary Examiner*—Philip R. Coe

*Attorney, Agent, or Firm*—Robert B. Aylor; Richard C. Witte; Thomas H. O'Flaherty

[57] ABSTRACT

The present invention comprises apparatus and process for laundering textiles based upon utilizing quantities of an aqueous liquid wash liquor in the wash step ranging from, at least, just enough to be substantially evenly and completely distributed onto all portions of the textiles to, at most, about 5 times the dry weight of the textiles to be laundered. This results in an extremely efficient use of the detergent composition. The present invention also comprises novel wash liquor and detergent compositions for use in said apparatus and process.

1 Claim, 6 Drawing Figures

WATER SUPPLY 93
82
81
80
96
101
106
105
83
91
92
90
89
98
85
84
99
94
87
88
86
97
95
175
176
164
166
165
163
160
161
174
110
180
67
66
65
172
162
170
169
171
167
168
173
190
47
240
120
230
300
15
37
38
27
35
61
36
100
20
10
70
71
40
72
2
63
143
60
142
140
141

PACKAGED DETERGENT COMPOSITION WITH INSTRUCTIONS FOR USE IN A LAUNDERING PROCESS

CROSS REFERENCE TO RELATED APPLICATION

This is a division of application Ser. No. 548,265, filed on Nov. 3, 1983, and now U.S. Pat. No. 4,489,455, which is a continuation-in-part of my copending application Ser. No. 436,169, filed Oct. 28, 1982, and now U.S. Pat. No. 4,489,574, which is a continuation-in-part of my application, Ser. No. 320,155, filed Nov. 10, 1981, now abandoned.

TECHNICAL FIELD

The present invention has relation to novel apparatus and process for laundering of textiles using small amounts of water and energy without substantial soil redeposition. This results in a superior level of detergency performance.

The present invention has further relation to novel apparatus and process for laundering of mixed textile loads comprised of dissimilar fiber and color types without substantial dye transfer from one textile to another.

The present invention has still further relation to novel wash liquor and detergent composition for use in said apparatus and process.

BACKGROUND INFORMATION

The conventional method of washing textiles in an automatic home-type washing machine in the United States is carried out in either a top loading or front loading machine. The difference between the two machines is that in a top loader the wash basket is rotatable around a substantially vertical axis and in a front loader the wash basket is rotatable around a substantially horizontal axis. Home-type top loading machines are, by far, the most popular, comprising about 90% of the United States' automatic washing machine market.

The processing for washing textiles in a home-type top loader begins by placing the textiles in the wash basket. In a normal capacity home-type top loader the wash basket can hold up to about 7 kilograms of textiles. Detergent composition is then added to the wash basket. Finally, water, which is typically heated, is added to the wash basket to form a water and detergent solution known as the wash liquor. Thus, formation of the wash liquor is carried out in the wash basket in the presence of the textiles to be washed. The washing step is then completed by applying mechanical agitation to the system in order to loosen and remove the soil from the textiles.

The temperature and level of water and level of detergent composition used in the wash step can vary. About 60% of the wash steps use warm water (typically around 35° C.), with the balance being evenly split between hot water (typically around 50° C.) and cold water (typically around 15° C.). The level of water and detergent composition used in this step typically ranges from about 40 liters to about 90 liters and from about 20 grams to about 145 grams, respectively, depending upon the wash basket size and load size. The resulting detergent composition concentration in the wash liquor is from about 210 parts per million (ppm) to about 3,600 ppm.

The wash liquor is then removed and the textiles are rinsed. The rinse step normally comprises adding clear water to the wash basket. Mechanical agitation is normally applied during the rinse step to remove the detergent composition from the textiles. Finally, the water is drained and the textiles are spun to mechanically remove as much water as possible. A cold water rinse is used in about 60% of the rinse steps, with the balance being warm water rinses. The amount of water used in this step is typically the same as that used in the wash step. The rinse step is generally repeated one or more times.

The wash cycle of the home-type front loader is very similar to that of the home-type top loader. The temperature of the water and detergent composition concentration used in the washing step are very similar to a home-type top loader. The basic difference is that the amount of water used in each of the wash and rinse steps typically ranges from about 25 liters to about 35 liters and, thus, the level of detergent composition is from about 10 grams to about 70 grams.

The complete conventional automatic wash process in a home-type top loader typically uses from about 130 liters to about 265 liters of water. By way of contrast, a home-type front loader, though more efficient, typically uses about 95 liters of water. This too is a considerable water expenditure for one wash cycle. Also, if the water is heated, there is a considerable energy expenditure. Both water and energy are costly to the consumer.

A known drawback normally exhibited by conventional automatic wash processes of the foregoing type is that soil redeposition occurs in both the wash and rinse steps. Soil redeposition is soil that is detached from the textiles and goes into the wash or rinse liquor and is then redeposited onto the textiles. Thus, soil redeposition substantially limits the "net" cleaning performance.

Another known drawback normally exhibited by conventional automatic wash processes of the foregoing type is that dye transfer can occur when dealing with loads of differently colored textiles. Dye transfer is the detachment of dye from a textile into the wash liquor and its subsequent deposition onto another textile. To avoid dye transfer the consumer has found it necessary to perform the additional step of presorting the textiles, not only by textile type but also by color type.

U.S. Pat. No. 4,344,198 issued to Arendt et al on Aug. 17, 1982 claims a process for the washing of clothes through a wash and rinse cycle in a washing machine with a horizontal, perforated, driven tub arranged inside a housing wherein the tub has at its rotating periphery a tangential area, in which during the washing and rinsing cycle as the tub rotates, the clothes are repeatedly lifted up and then fall in a trajectory path onto the lower portion of the tub and are then distributed without unbalance to the tub, as the tub velocity is gradually increased. The clothes are then centrifuged as the velocity is increased further. According to Arendt, his improvement comprises the steps of wetting the clothes with an amount of suds that gives a "doughy" consistency to the clothes by filling the tub with suds until the level of suds does not significantly rise above the tangential area of the tub by maintaining in the tub during washing an aqueous medium level of at least about 5% of the tub's diameter, whereby the dry clothes are loaded individually into the tub which rotates at a speed at which the centrifugal velocity at the tub case is about 0.3–0.8 g. The tub speed is then increased to about 1 g. then gradually changed to a spin speed and after the spinning, reduced to a velocity in keeping with the loading speed. The process is thereafter followed with a rinse cycle which is similar to the washing cycle. According to Arendt, the exchange between "engaged" and "free" medium is achieved not so much by leaching but by the mechanical action of the tub. Finally, Arendt teaches that water is saved for the most part not by using smaller ratios of total media, but by reducing the number of wash and rinse cycles.

U.S. Pat. No. 4,118,189 issued to Reinwald et al on Oct. 3, 1978 discloses a wash process which consists of transforming a concentrated wash liquor, by the introduction of compressed air, into a foam which is thereafter applied to the soiled textiles. The textiles are mechanically agitated in the foam for at least thirty seconds, then the foam is destroyed and removed from the textiles by spinning the textiles in a rotary perforated drum. This cycle is repeated at least five times, followed by conventional rinsing. Reinwald suggests that the dirt detached from the textile material and dispersed in a relatively highly concentrated detergent solution is partially deposited again on the textile fiber during the subsequent rinsing due to a dilution of the wash liquor.

Still another attempt at using more concentrated wash liquor without encountering redeposition problems of the type discussed in the aforementioned patent issued to Reinwald is disclosed in U.S. Pat. No. 3,650,673 issued to Ehner on Mar. 21, 1972. Ehner discloses method and apparatus for washing textiles utilizing an amount of water corresponding to about 50% to 150% of the dry weight of the textiles. The process consists of placing such quantities of water, the textiles to be laundered and a transfer agent, e.g., polyethylene foam having a large surface area per unit mass, in a rotatable enclosure similar to those employed in a front loader type washing machine and tumbling these materials together for a period of time. Soils removed from the textiles by the tumbling action are distributed over the combined exposed surface areas of the textiles and the transfer agent, which is subsequently separated from the textiles. Thus, the textiles are cleansed of the soils distributed onto the transfer agent. Ehner admits that a quantity of soil will be left on the textiles, but teaches that it will be substantially reduced from the original quantity and will be distributed so as to leave no objectionable areas of soil concentration. Following separation of the soil carrying transfer agent from the textiles, the textiles are subsequently dried in the same rotatable enclosure in which they are "washed" by tumbling them while circulating warm dry air therethrough.

U.S. Pat. No. 3,647,354 issued to Loeb on Mar. 7, 1972 suggests that a wash process such as that disclosed in the aforementioned Ehner patent be followed by a rinse process employing a quantity of water sufficient only to bring the textiles to a condition of dampness. According to Loeb, the textiles are tumbled in a rotating drum with a clean transfer agent which functions in a manner similar to the transfer agent used in the wash process to separate detergent and loosened soils from the textiles.

Despite the advantages allegedly provided by wash processes of the foregoing type, they have not met with widespread commercial acceptance, particularly in the home laundry market.

Accordingly, an object of the present invention is to provide apparatus and process for laundering textiles using a small amount of water, yet minimizing soil redeposition and dye transfer, even without presorting of the textiles to be laundered.

Another object of the present invention is to provide apparatus and process for laundering textiles which makes extremely efficient use of the detergent composition utilized and, if applied, extremely efficient use of heat energy.

Another object of the present invention is to provide preferred apparatus and process for laundering textiles using cold water.

A further object of the present invention is to provide apparatus and process for laundering textiles which results in superior cleaning as well as preservation of the textiles' appearance over many laundering cycles.

A still further object in a preferred aspect of the present invention is to provide apparatus and process for laundering textiles wherein mechanical energy can be applied to textiles which have been contacted with a concentrated wash liquor without creating a suds problem.

A still further object of the present invention is to provide wash liquor compositions and detergent compositions for use in said apparatus and process.

DISCLOSURE OF THE INVENTION

The present invention comprises apparatus and process for laundering textiles based upon utilizing quantities of an aqueous liquid wash liquor in the wash step ranging from, at least, just enough to be substantially evenly and completely distributed onto all portions of the textiles to, at most, about 5 times the dry weight of the textiles to be laundered. This results in an extremely efficient use of the detergent composition. Nearly all of the wash liquor, and therefore nearly all of the detergent composition contained in the wash liquor, will be in intimate contact with the textiles throughout the wash step of the present laundering process. Accordingly, the detergent composition is able to effectively and efficiently interact with the soil. This step is crucial to the process. Consequently, a superior level of cleaning performance is achieved. However, in order to obtain such performance for the entire wash load, especially with lower amounts of wash liquor, it is essential that the wash liquor be substantially evenly and completely distributed onto the textiles. In a preferred embodiment the upper limit of the quantity of wash liquor is such that there is none or minimal amounts of wash liquor in excess of the absorption capacity of the textiles and more preferably the wash liquor is not in excess of about 2½ times the dry weight of the textiles. In the final step or steps of the process the textiles are rinsed with water to simultaneously remove both the soil and the detergent composition. A conventional home-type top loader or front loader rinse cycle is effective for such a purpose, but the rinse can be accomplished with reduced quantities of water. While the process is particularly beneficial when carried out on family-type wash loads comprised of mixed fabric and color types, the process may also be utilized to advantage on an industrial laundry scale.

The present invention further comprises wash liquor compositions and detergent compositions for use in said apparatus and process.

BRIEF DESCRIPTION OF THE DRAWINGS

While the Specification concludes with claims particularly pointing out and distinctly claiming the present invention, it is believed the present invention will be better understood from the following description in which:

DETAILED DESCRIPTION OF THE INVENTION

A. PREFERRED APPARATUS

Figure 1:
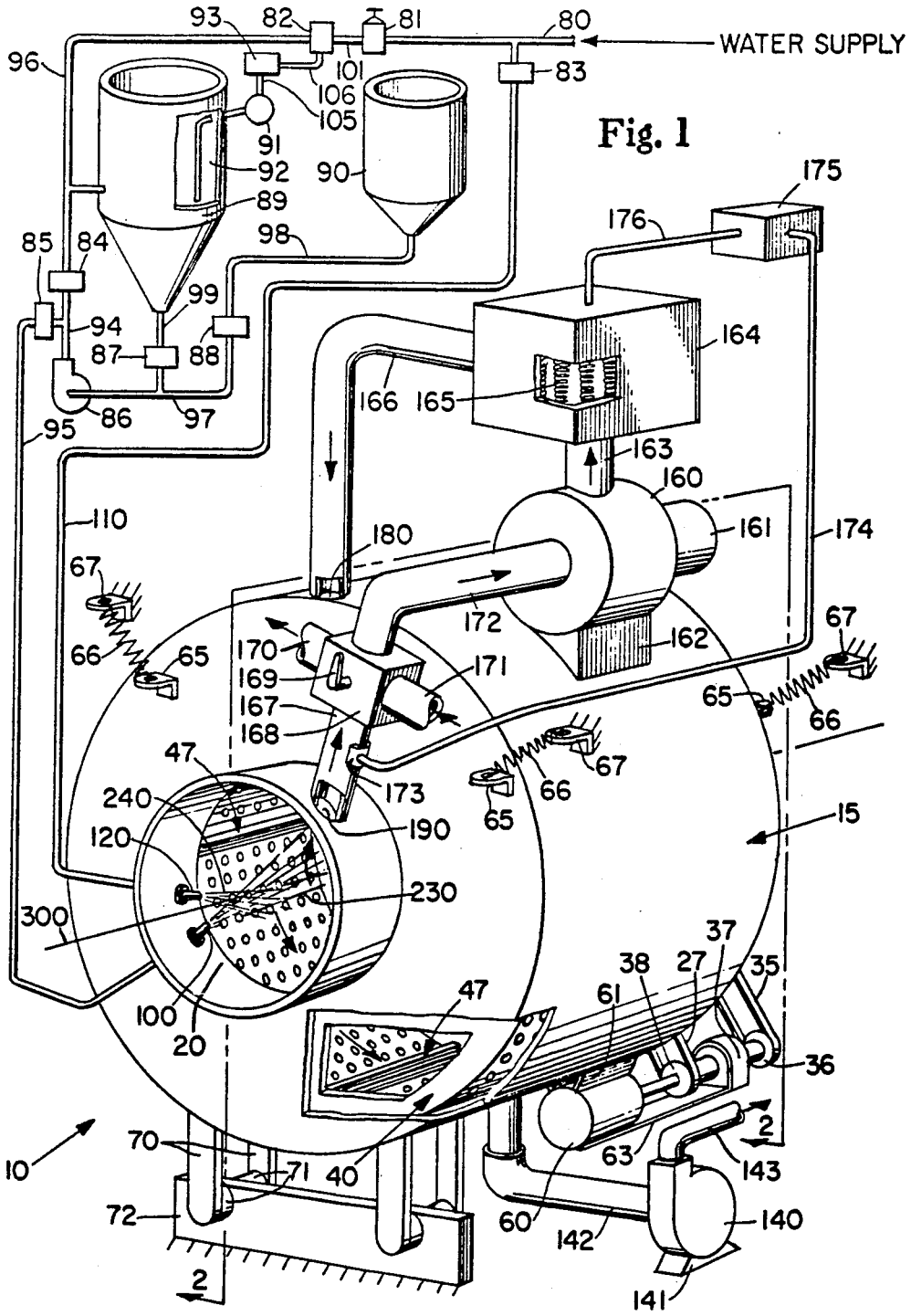
FIG. 1 is a schematic perspective illustration of particularly preferred apparatus for carrying out the present laundering process.

Disclosed in FIG. 1 is a schematic illustration of particularly preferred apparatus for carrying out a laundering process in accordance with the present invention. FIG. 1 discloses a preferred embodiment of a washing machine 10 of the present invention. The apparatus in FIG. 1 is particularly preferred when the quantity of wash liquor utilized is, at most, about 2½ times the dry weight of the textiles to be laundered. Such maximum quantity of wash liquor approaches the maximum absorption capacity of an average wash load. For purposes of clarity, none of the details of the cabinet nor the access door is shown in FIG. 1.

In the embodiment of FIG. 1, the washing machine 10 comprises a stationary drum 15 of generally cylindrical construction and having a horizontal access opening 20. The centerline of the cylindrical stationary drum 15 coincides with the axis of rotation 300 of a movable drum 40 (sometimes referred to in the prior art as a wash basket) mounted within stationary drum 15.

Figures 2, 2A:
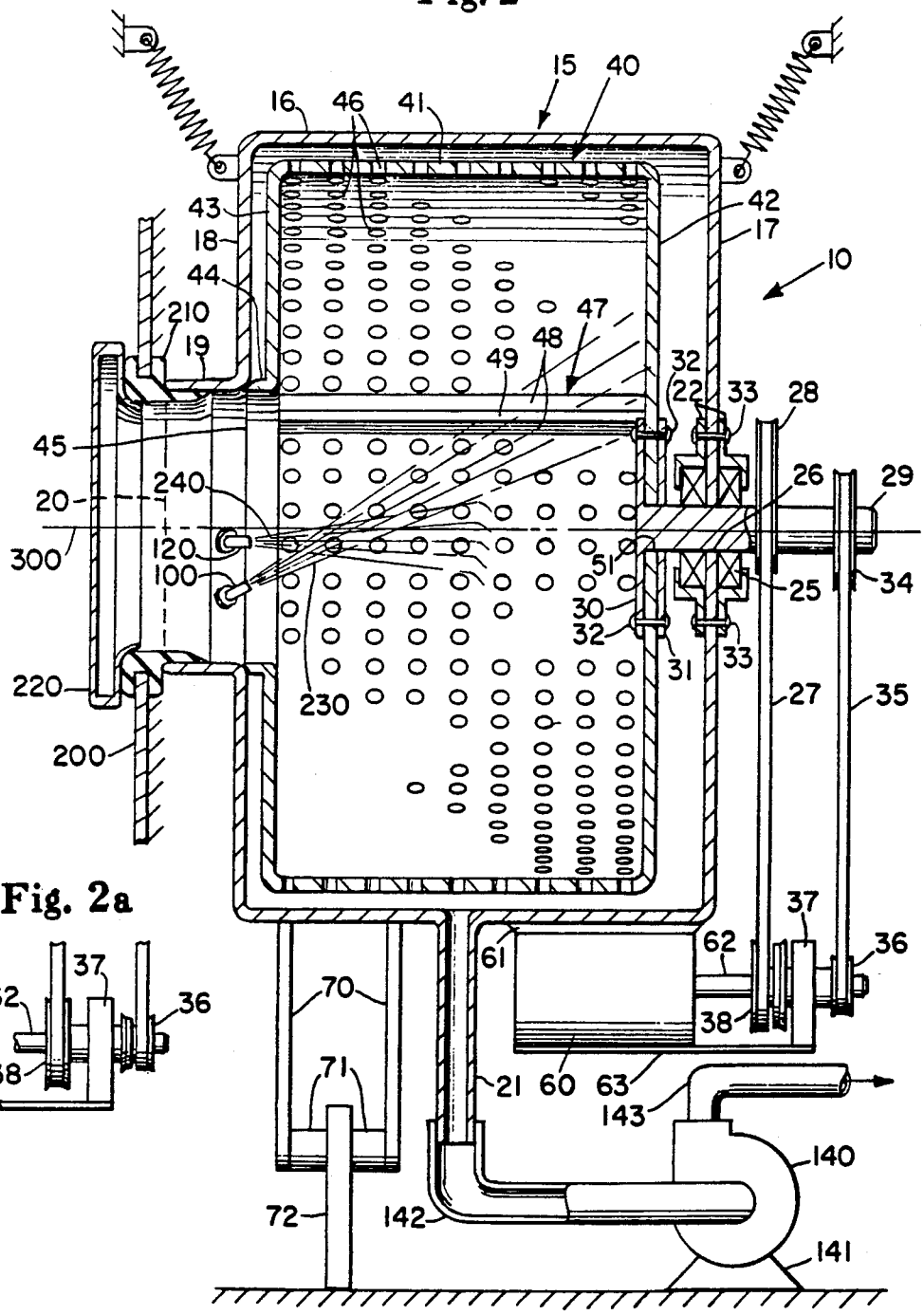
FIG. 2 is a cross-sectional illustration of the embodiment disclosed in FIG. 1 taken along section line 2—2 of FIG. 1.
FIG. 2A is an inset of the drive pulley system shown in FIG. 2 with the pulley-actuating clutch assembly in its alternative position.
Figure 3:
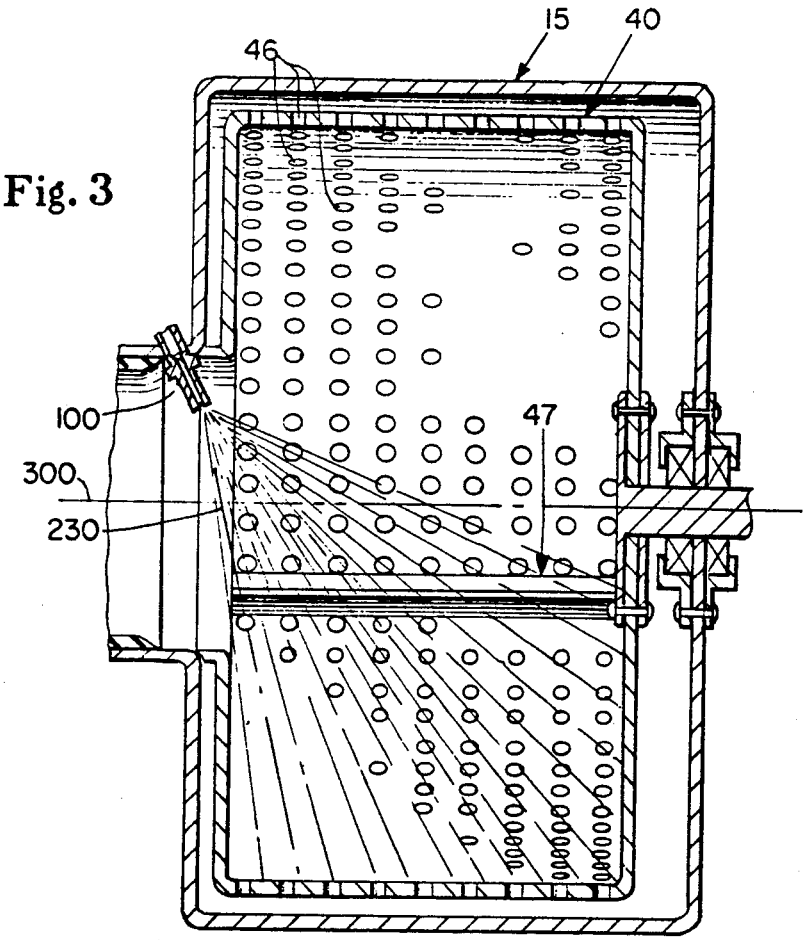
FIG. 3 is a cross-sectional segment of the apparatus illustrated in FIG. 1 taken in a plane which passes through the center of the wash liquor applicator nozzle and the axis of rotation of the movable drum disclosed in FIG. 1.

As is more clearly illustrated in the cross-sectional views of FIGS. 2 and 3, stationary drum 15 comprises a peripheral wall 16, a back wall 17 secured to one edge of the peripheral wall, a front wall 18 secured to the opposite edge of the peripheral wall, said front wall having a tubular-shaped extension 19 having an access opening 20 used to load and unload laundry from the washing machine 10. Access opening 20 forms a seal with pliable sealing gasket 210 which is secured about its outermost periphery to the front wall 200 of the washing machine cabinet. When the washing machine 10 is in operation, the washing machine's access door 220 is in the closed position shown in FIG. 2 and forms a watertight seal against the outermost portion of pliable sealing gasket 210. These latter elements are illustrated only in the cross-section of FIG. 2 to ensure maximum clarity in the remaining drawing figures. The lowermost portion of stationary drum 15 is provided with a drain connection 21 located in peripheral wall 16. The drain connection 21 is connected by means of a flexible connecting line 142 to the suction side of a rinse liquor discharge pump 140 which is secured by means of support 141 to the base of the washing cabinet (not shown). Connecting line 143 conveys rinse liquor discharged from the pump 140 to a sewer drain (not shown).

As can also be seen in FIGS. 1 and 2, stationary drum 15 is supported by means of four suspension springs 66 which are connected at one end to anchor means 65 secured to the uppermost portion of the stationary drum 15 and at their other end to fixed anchor means 67 which are secured to the washing machine cabinet (not shown).

Extending from the lowermost portion of peripheral wall 16 are four support members 70, the lowermost ends of which are secured to motion limiting damper pads 71. A vertical guide plate 72 passes between the two sets of motion limiting damper pads 71. Sufficient clearance is provided between the motion limiting damper pads 71 and the guide plate 72, which is secured to the base of the washing machine cabinet (not shown), so that the stationary drum 15 may undergo limited up-and-down and side-to-side movement while access opening 20 and tubular extension 19 remain in sealed engagement with pliable sealing gasket 210. The resilient mounting of stationary drum 15 minimizes the transmission of vibration which occurs during moments of imbalanced loading to the washing machine cabinet (not shown).

Located inside stationary drum 15 is a movable drum 40 comprising a perforated peripheral wall 41, a substantially imperforate back wall 42 secured to one edge of said peripheral wall and a substantially imperforate front wall 43 secured to the opposite edge thereof. Extending from the front wall 43 of the movable drum 40 is a tubular-shaped extension 44 which terminates in an access opening 45 which is concentrically aligned with the access opening 20 in stationary drum 15. Equally spaced on the inner circumference of peripheral wall 41 are three lifting vanes 47 of substantially triangular cross-section. The innermost edge of the side walls 48 of the triangular-shaped vanes 47 preferably terminate to form an innermost land area 49. In a particularly preferred embodiment, each of the vanes is symmetrically-shaped about a radially extending line originating at the axis of rotation 300 of movable drum 40 and passing through its altitude. This permits rotation of movable drum 40 in opposite directions with equal lifting effect on the articles being laundered.

In an exemplary embodiment of a washing machine 10 of the present invention, the movable drum 40 measured approximately 21½" (54.6 cm.) in diameter by approximately 12" (30.5 cm.) in depth, while the triangular-shaped lifting vanes 47 exhibited a base of approximately 2" (5.1 cm.) in width by 9" (22.9 cm.) in depth, an overall altitude of approximately 3" (7.6 cm.) and a land area 49 measuring approximately 1" (2.5 cm.) in width by 7" (17.8 cm.) in depth. The inner movable drum 40 exhibited approximately 750 uniformly spaced perforations 46, each perforation having a diameter of approximately ¼" (0.635 cm.). The stationary drum 15 enclosing the aforementioned movable drum 40 measured approximately 24" (61 cm.) in diameter.

As will be apparent from an inspection of FIG. 2, movable drum 40 is rotatably secured to stationary drum 15 by means of driveshaft 29. The innermost end of driveshaft 29 incorporates an integral flange 30 which is secured by means of companion flange 31 and a multiplicity of fasteners, such as rivets 32, to the back wall 42 of movable drum 40. The shaft portion of driveshaft 29 passes through a clearance hole 51 in the back wall 42 of movable drum 40 and is supported by means of a pair of bearings 25 secured to the back wall 17 of stationary drum 15. Bearings 25 are secured in position by means of bearing retainers 22 which are joined to one another and to the back wall 17 by a multiplicity of conventional fasteners, such as rivets 33. The shaft portion of driveshaft 29 passes through a clearance hole 26 in back wall 17 of stationary drum 15.

Power to rotate movable drum 40 is transmitted to the external portion of driveshaft 29 either by means of an eccentrically mounted driven pulley 28 or by means of a concentrically mounted driven pulley 34 which are both secured in fixed relation to driveshaft 29. As will be explained in greater detail hereinafter, the eccentrically mounted driven pulley 28 is used to vary the speed of rotation of the movable drum 40 throughout each revolution of the drum, while the concentrically mounted driven pulley 34 is used to drive the movable drum 40 at a constant speed of rotation throughout each revolution.

The drive system for the movable drum 40 preferably comprises a variable speed drive motor 60 secured by means of support 61 to the peripheral wall 16 of stationary drum 15. Because the drive motor 60 is secured to the stationary drum 15, any movement of the stationary drum 15 does not affect the speed of rotation of movable drum 40. The output shaft 62 of drive motor 60 has secured thereto a concentrically mounted drive pulley 38 and a concentrically mounted drive pulley 36. A two-position, pulley-actuating clutch assembly 37 is positioned intermediate pulleys 36 and 38. Drive pulleys 36 and 38 are both of two-piece construction so as to permit engagement or disengagement of their respective drive belts by pulley-actuating clutch assembly 37. The housing of clutch assembly 37 through which drive motor shaft 62 freely passes is preferably secured to the housing of drive motor 60 by means of a laterally extending support 63, as generally shown in FIGS. 1 and 2.

Concentrically mounted drive pulley 38 is connected to eccentrically mounted driven pulley 28 by means of a conventional drive belt 27. Likewise, concentrically mounted drive pulley 36 is connected to concentrically mounted drive pulley 34 by means of a conventional drive belt 35. When clutch assembly 37 is in its first position, the distance between the opposing faces of drive pulley 36 is sufficiently great that drive belt 35 is allowed to freely slip therebetween when driveshaft 29 revolves. When clutch assembly 37 is actuated into its second position, the opposing faces of drive pulley 36 are brought sufficiently close together that drive belt 35 is driven by pulley 36. Simultaneously, the distance between the opposing faces of drive pulley 38 is increased to a distance which is sufficiently great that drive belt 27 is allowed to freely slip therebetween when driveshaft 29 revolves. FIG. 2 depicts drive pulley 36 in the engaged position, while the inset of FIG. 2A depicts drive pulley 38 in the engaged position.

In a particularly preferred embodiment of the present invention, drive motor 60 is not only variable speed, but is also reversible so that movable drum 40 may be rotated first in one direction and then in the opposite direction throughout the various portions of the laundering cycle. It is believed that reversing the direction of drum rotation several times during the laundering cycle will provide more uniform application of the wash liquor, more uniform agitation and more uniform heat transfer to the textiles being laundered, and hence more effective cleansing.

In the exemplary washing machine embodiment described earlier herein, the eccentrically mounted driven pulley 28 was used to provide rotation of the movable drum 40 at a speed which varied from about 48 to about 58 revolutions per minute during each complete revolution of the drum, while the concentrically mounted pulley system comprising pulleys 36 and 34 was used to provide rotation of the movable drum at a constant speed of about 544 revolutions per minute.

Referring again to the particularly preferred embodiment of FIG. 1, there is shown an air circulating blower 160, preferably of the centrifugal variety, secured by means of a support 162 to an upper portion of peripheral wall 16 of the stationary drum 15. The air circulating blower 160 is preferably powered by variable speed drive motor 161. A connecting duct 163 conveys air from the blower discharge to a heater 164. The heater 164 includes a heating element 165 over which the air must pass prior to entering connecting duct 166 which conveys heated air from the heater 164 to an inlet opening 180 located in the peripheral wall 16 of the stationary drum 15. In the embodiment disclosed in FIGS. 1–3, heated air is introduced intermediate the peripheral wall 16 of stationary drum 15 and the peripheral wall 41 of movable drum 40. The bulk of the heated air introduced in this area is forced to enter movable drum 40 via perforations 46 located in peripheral wall 41. As pointed out earlier herein, the movable drum 40 is caused to rotate at varying speed during the laundering portion of the cycle via the eccentrically mounted pulley 28. Since the articles being laundered are normally located at or adjacent the innermost surface of peripheral wall 41 of movable drum 40 during the laundering cycle, the heated air introduced between the stationary and movable drums is caused to penetrate the textiles being laundered on its way to return opening 190 located in tubular extension 19 of stationary drum 15.

Return opening 190 is connected to a diverter valve 168 by means of connecting duct 167. Diverter valve 168 has two positions. In its first position, connecting ducts 170 and 171 are blocked off and all of the humid air withdrawn from stationary drum 15 is returned to the suction side of air circulating blower 160 via connecting duct 172. As will be explained in greater detail in the ensuing preferred process description, diverter valve 168 remains in its first position during the laundering portion of the cycle described herein. The temperature of the returning air is sensed in connecting duct 167 by means of a sensing element 173 mounted in the duct. The sensing element 173, which is preferably of the thermistor type, sends a signal to temperature controller 175 via signal transmission line 174. The temperature controller 175, which is preferably adjustable, transmits a signal via signal transmission line 176 to the heating element 165 in heater 164 to either raise, lower or maintain the temperature of the air being introduced into connecting duct 166. Thus, the heated air employed during the laundering portion of the cycle is continually recirculated by means of the aforementioned closed loop system, and its temperature is continuously monitored and maintained at a predetermined level.

In a particularly preferred embodiment of the present invention, the washing machine 10 may also be employed as a clothes dryer. This is accomplished by manipulation of diverter valve 168. Advancing control lever 169 from the aforementioned first position of the diverter valve to a second position connects air duct 171 with return air duct 172 and air duct 170 with return air duct 167. Since air ducts 170 and 171 are both vented to atmosphere, the effect of advancing the diverter valve 168 to its second position is to convert the closed loop recirculation system described earlier herein in conjunction with the laundering cycle to a non-recirculating vented system. In the vented mode of operation, fresh air is drawn into duct 171 and routed through the heater as before to provide warm dry air for drying the laundered textiles contained within movable drum 40. Similarly, the moist air withdrawn from stationary drum 15 is discharged to the atmosphere via connecting duct 170 rather than being recirculated to the suction side of the air circulating blower 160. During the drying portion of the cycle, movable drum 40 is rotated, as during the laundering cycle, by drive motor 60 operating through the eccentrically mounted pulley and drive belt system described earlier herein. Temperature of the air used during the drying cycle is also monitored and controlled by sensing element 173 and temperature controller 175. However, the temperature selected during the drying cycle may differ from that employed during the laundering cycle. Accordingly, the temperature controller 175 preferably has two independently adjustable set points which may be preadjusted to different temperature levels for the laundering and drying cycles.

As will be readily apparent to those skilled in the art, diverter valve control lever 169 may be automatically actuated rather than manually actuated, as disclosed in the present illustrations. This may be accomplished utilizing solenoids or similar control apparatus well known in the art therefore not shown.

In the exemplary washing machine embodiment described earlier herein, the air circulating blower 160 utilized to recirculate the humid air during the laundering portion of the cycle had a rated capacity of 460 cubic feet (13.03 cubic meters) of air per minute at a pressure of 0.25" (0.635 cm.) of water, and the connecting ducts used to construct the recirculation loop were sized to permit recirculation of the air at rated flow. The heater 164 employed on the exemplary machine contained a heating element 165 comprising a 240 volt AC, 5200 watt, spiral wound, nichrome coil. The temperature sensing element 173 comprised a thermistor inserted into return air duct 167. Temperature controller 175 comprised a 0°-200° F. (−17.8°-93.3° C.) adjustable unit having a set point accuracy of 3% of range and a set point stability of 2% of span from the nominal setting. A high limit snap disc-type thermostat (not shown) having a range of 400°-450° F. (204.4°-232.2° C.) was also utilized to protect the system.

Referring again to FIGS. 1-3, preferred wash liquor and rinse liquor systems are disclosed. In particular, the wash liquor utilized during the laundering portion of the cycle is prepared in wash liquor reservoir 89 which is schematically illustrated in FIG. 1. In a particularly preferred form of the present invention, the cycle is initiated by introducing a predetermined amount of detergent composition, which may be in granular, paste, gel or liquid in form, into the wash liquor reservoir 89. Water from supply line 80 passes through pressure regulator 81, connecting line 101 and control valves 82, 84 and 87, which are in the open position, into the side of wash liquor reservoir 89 via connecting lines 96, 94 and 99. Control valves 85 and 88 are closed at this point in time to prevent the water from escaping via delivery lines 95 and 98. Located within wash liquor reservoir 89 is a level sensing probe 92 which is connected at its uppermost end to a level sensor 91. The level of the liquid introduced into the wash liquor reservoir rises along probe 92. When the liquid level within reservoir 89 reaches a predetermined point, level sensor 91 transmits a signal to level controller 93 via signal transmission line 105. Level controller 93 sends a signal via signal transmission line 106 to close off control valve 82. After control valve 82 has been closed, pump 86 is started to initiate recirculation, mixing and formation of a wash liquor within reservoir 89. Control valves 85 and 88 remain closed during the mixing cycle. Pump 86 withdraws liquid from the bottom of wash liquor reservoir 89 via connecting lines 99 and 97 and discharges the liquid withdrawn back into the reservoir via connecting lines 94 and 96. Recirculation of the liquid is carried out until such time as the detergent composition is substantially dissolved or dispersed in the water. The time required will of course vary, depending upon such variables as the solubility characteristics of the particular detergent composition employed, the concentration of detergent composition, the temperature of the incoming water and like. To minimize the mixing time, it is generally preferred to design the liquid recirculation loop to maximize the turbulence of flow during recirculation.

Another preferred wash liquor addition system comprises the dispenser described in *Automatic Dispensing System for Washing Machine Additives,* Research Disclosure, February 1982, pp. 42-44, said disclosure being incorporated herein by reference. Such a dispenser is preferably modified for use in the present process by providing either a recirculation loop or a separate reservoir and/or additional devices such as a venturi to create additional turbulence and thereby expedite mixing and formation of the wash, or other treatment, liquor. The individual reservoirs of this dispenser can be connected to a single intermediate mixing reservoir with optionally a recirculation loop to simplify the mixing and eventual distribution of the liquor. Such a dispenser in combination with the spray means enables one to apply a series of treatments sequentially for optimum performance. It is possible to apply enzymes, bleach, softeners and antistatic agents, soil release agents, brighteners, etc. in sequential order either with or without intervening rinses to promote the effectiveness of each treatment.

As will be explained in greater detail in conjunction with the ensuing preferred process description, the present laundering process may be carried out without the addition of heat energy via heating element 165. However, experience to date has demonstrated that it is generally preferable that wash liquor and rinse liquor temperatures be in the range of about 25° C. or higher to maximize the benefits afforded by the present process. To achieve this objective when the heat energy addition option is not employed during the laundering cycle, a water preheating unit (not shown) may be utilized on the incoming water supply line to ensure that the temperature of the incoming water does not fall below about 25° C., even during cold weather conditions.

As pointed out earlier herein, a relatively small amount of wash liquor is utilized during the present laundering process when compared to prior art laundering processes. Accordingly, the method of applying the wash liquor to the textiles to be laundered must be highly effective in order to provide substantially even and complete distribution, especially when very reduced quantities of wash liquor are utilized. One particularly preferred means of accomplishing this objective has been to apply the wash liquor by means of a high pressure spray nozzle 100 as the movable drum 40 rotates. During the wash liquor application step control valves 82 and 88 are closed and control valves 84, 85 and 87 are opened. Wash liquor 230 is withdrawn from reservoir 89 by means of pump 86 and is conveyed via flexible delivery line 95 to high pressure spray nozzle 100 which, in the illustrated embodiment, is mounted in the tubular-shaped extension 19 of stationary drum 15. A small amount of wash liquor is also permitted to flow through valve 84 and delivery line 96 back into reservoir 89 to provide some recirculation and mixing during the wash liquor application cycle. As can be seen from FIG. 3, which is a simplified diametral cross-section taken through spray nozzle 100 and the axis of rotation 300 of movable drum 40, high pressure nozzle 100 is located at approximately the 8 o'clock position and a substantially flat, fan-shaped spray of wash liquor 230 is targeted to strike peripheral wall 41 and back wall 42 of the movable drum 40 which, in the illustrated embodiment, is rotating in a counterclockwise orientation, at approximately the 2 o'clock position.

In order to distribute the textiles to be laundered substantially uniformly about the periphery of the movable drum 40, the textiles are initially tumbled at low speed via eccentrically mounted driven pulley 28. Movable drum 40 is thereafter accelerated by concentrically mounted driven pulley 36 to a speed which is sufficient to hold the substantially uniformly distributed articles against peripheral wall 41. The wash liquor application step is initiated while the articles are held against peripheral wall 41. However, after several revolutions of movable drum 40, the speed of drum rotation is reduced by transferring the input driving force from concentrically mounted driven pulley 36 back to eccentrically mounted driven pulley 38. The slower speed of rotation, which varies throughout each revolution of movable drum 40, causes the textiles within the drum to be carried by lifting vanes 47 to approximately the 1 o'clock position, at which point they tend to fall away from peripheral wall 41 and pass through the substantially flat, fan-shaped spray of wash liquor 230 on their return to the bottom of the drum.

While in the illustrated embodiment, the drum rotation is oriented in a counterclockwise direction, it has also been learned that the drum may, if desired, be rotated in a clockwise direction. In the latter case the textiles which fall away from the peripheral wall 41 at approximately the 11 o'clock position still pass through the fan-shaped spray of wash liquor 230 on their return to the bottom of the drum.

The wash liquor application step is carried out until all or a predetermined amount of the wash liquor contained in reservoir 89 has been applied to the textiles being laundered. The quantity of wash liquor applied for a given laundering cycle will vary, depending upon such factors as the quantity of textiles being laundered, their materials of construction, and the soil type and level of soil loading, as more fully described in the accompanying detailed process description. When the wash liquor application step has been completed, even with the smallest quantities of wash liquor within the invention, the wash liquor is substantially evenly and completely distributed onto the textiles being subjected to the present laundering process.

To further enhance distribution, wash liquor application may be carried out in several stages, with the movable drum 40 being momentarily stopped and restarted between each stage to allow the articles to completely redistribute themselves prior to each stage of wash liquor application. Similarly, multiple spray nozzles may be employed.

Figure 4:
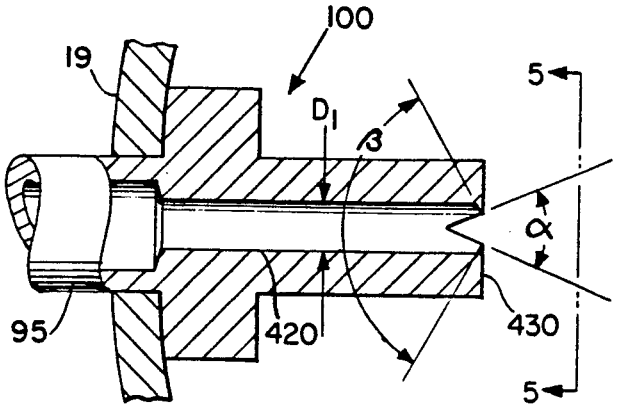
FIG. 4 is a simplified cross-sectional illustration of a particularly preferred wash liquor applicator nozzle.
Figure 5:
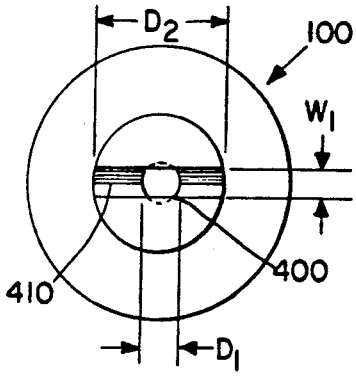
FIG. 5 is an end view of the wash liquor applicator nozzle shown in FIG. 4.

FIGS. 4 and 5 disclose the internal configuration of the spray nozzle 100 employed in the exemplary washing machine embodiment described earlier herein. In particular, an irregularly-shaped orifice 400 is formed by intersection of a V-shaped groove 410 having an included angle $\alpha$ of approximately 45° extending across the nozzle's face 430 and a cylindrical passageway 420 passing through its longitudinal axis. A cross-sectional view of this exemplary nozzle 100 is generally disclosed in FIG. 4, and an end view taken along view line 5—5 is shown in FIG. 5. The maximum width W of the aforementioned groove 410 was approximately 0.075" (0.19 cm), as measured at the face 430 of the nozzle. The diameter $D_2$ of the nozzle face 430 was approximately 0.40" (1.02 cm.). The diameter $D_1$ of passageway 420 was approximately 0.125" (0.32 cm.) along its length, converging at an included angle $\beta$ of approximately 120° adjacent the nozzle face 430. Intersection of groove 410 and passageway 420 produced the irregularly shaped orifice 400 generally shown in FIG. 5. Wash liquor was fed by means of a pump 86 having a rated capacity of 500 gallons per hour at 7 psi connected to nozzle 100 via a ¼" (0.635 cm.) diameter flexible delivery line 95. The nozzle 100 was installed in tubular shaped extension 19 at approximately the 8 o'clock position with its spray oriented so as to strike peripheral wall 41 and back wall 42 of movable drum 40, as generally shown in FIG. 3. Drum rotation was oriented clockwise when viewed from its front wall side.

While spraying has been found to be a particularly preferred method of wash liquor application, other application means, e.g., atomizers, which will produce a similar distribution of wash liquor throughout the textiles to be laundered, as described in the accompanying detailed process description, may be employed with equal success.

After the wash liquor application has been completed, preferably mechanical energy is applied to the textiles by rotating movable drum 40 at relatively low speed such that the textiles being laundered are continually lifted by vanes 47 secured within the movable drum and caused to mechanically tumble back toward the bottom of the drum. As pointed out earlier herein, the tumbling action is accentuated by varying the speed of rotation of the movable drum 40 throughout each revolution of the drum. This is accomplished in the machine embodiment disclosed in FIG. 1 by driving the movable drum 40 via eccentrically mounted driven pulley 28. In a particularly preferred embodiment of the invention, the direction of rotation of movable drum 40 is reversed several times throughout the laundering cycle. This provides more thorough mechanical agitation of the textiles being laundered and, hence, more uniform heat transfer throughout the textiles. In addition, it minimizes the tendency of textiles, particularly long and thin appendages on textiles, e.g., sleeves on shirts, from becoming knotted up.

Heat energy is preferably supplied to the textiles being laundered during the aforementioned mechanical agitation process. In the machine embodiment disclosed in FIG. 1 this is accomplished by recirculating moist humid air through heater 164 using air handling blower 160. Preferred air temperature ranges and cycle times are specified in the accompanying detailed process description.

Following the mechanical and/or heat energy application phase of the present laundering process, the textiles contained within the movable drum 40 are rinsed with an aqueous rinse liquor 240, which in a particularly preferred embodiment comprises water. This is supplied from water supply line 80 via control valve 83 which is opened to permit delivery of rinse water to movable drum 40 via flexible delivery line 110 and applicator nozzle 120. Applicator nozzle 120 is also preferably mounted in the tubular shaped extension 19 of stationary drum 15. Applicator nozzle 120 need not, however, be a high pressure spray nozzle such as that utilized to apply wash liquor. Because free standing liquor is employed in movable drum 40 during the rinse portion of the present laundering cycle, it is believed that the particular manner of applying the rinse liquor to the laundered textiles is much less critical than the manner of applying the wash liquor. Accordingly, the rinse liquor may be added by any of several means well known in the art, e.g., directly into stationary drum 15 via an orifice in peripheral wall 16.

The textiles being laundered are preferably subjected to mechanical agitation during both the rinse liquor addition and the rinse cycles. This is preferably done by rotating movable drum 40 at relatively low speed via eccentrically mounted driven pulley 28. As with the mechanical energy and heat energy application phase of the laundering cycle, the direction of rotation of movable drum 40 is preferably changed several times during the rinse cycle to ensure more uniform rinsing.

In a particularly preferred embodiment, several relatively short rinse cycles are employed to remove the loosened soil and detergent from the textiles being laundered.

It is believed preferable to remove the rinse water from movable drum 40 during the initial rinse cycles without resorting to high speed centrifugation, i.e., high speed rotation of movable drum 40. While not wishing to be bound, it is believed that avoidance of centrifugation during the early rinse cycles minimizes the chance of redepositing suspended soils onto the textiles being laundered, since the rinse liquor is not forced through the textiles being laundered on its way to the perforations 46 in peripheral wall 41 of movable drum 40. Accordingly, centrifugation to remove as much moisture as possible from the laundered and rinsed textiles is preferably deferred until the last rinse cycle. As will be clear from an inspection of FIGS. 1 and 2, rinse water which is removed from movable drum 40 either by gravity or by centrifugation is ultimately removed from stationary drum 15 through drain connection 21 by means of discharge pump 140 from whence it is preferably conveyed to the sewer.

If desired, laundry additives of various types, e.g., fabric softeners, may be employed in conjunction with the laundering process described herein. If desired, such additives may be applied to the articles being laundered by conventional gravity addition (not shown) or via pressure spray nozzle 100. In the latter instance, one or more secondary reservoirs 90 may be employed. The discharge of these secondary reservoirs may be connected, as by delivery line 98 and control valve 88, to the wash liquor mixing system.

Depending upon the nature of the additive, it may be desirable to flush the wash liquor reservoir 89 with water prior to introducing the additive into the reservoir. This may be done by refilling the reservoir with water and recirculating the solution via pump 86 prior to discharging it into one of the rinse cycles. After wash liquor reservoir 89 has been flushed, control valve 88 may be opened to permit delivery of an additive from reservoir 90 to the wash liquor reservoir via pump 86. When a predetermined quantity of the additive has been transferred to wash liquor reservoir 89, a water dilution cycle may, if desired, be carried out in a manner similar to that employed for mixing the wash liquor, i.e., water from the supply line is added to reservoir 89, control valves 82, 85 and 88 are closed, and the additive solution is recirculated via pump 86 to the wash liquor reservoir 89 until such time as the additive is ready for application to the articles being laundered. Application of the mixed additive solution may thereafter be carried out during one or more of the rinse cycles employed in the present process in a manner generally similar to that employed for the application of the wash liquor.

Following centrifugation by high speed rotation of movable drum 40 to mechanically remove as much rinse liquor as is feasible, the washing machine 10 may be operated as a conventional clothes drying apparatus by actuating diverter valve 168 form its first position to its second position. In its second position, diverter valve 168 permits fresh air to be drawn into connecting duct 171 via suction from blower 160, heated to a predetermined temperature by heater 164, circulated through the laundered and rinsed textiles contained in rotating drum 40 and vented from stationary drum 15 to the atmosphere via connecting duct 170. As will be appreciated by those skilled in the art, movable drum 40 is preferably operated at low speed via eccentrically mounted driven pulley 28 throughout the drying cycle to provide more uniform air flow and heat transfer through the laundered and rinsed textiles contained therein.

PREFERRED PROCESS

Another aspect of this invention comprises a process for laundering textiles, hereinafter referred to as the "concentrated laundering process". The process utilizes quantities of an aqueous liquid wash liquor in the wash step ranging from, at least, about just enough to be substantially evenly and completely distributed onto all portions of the textiles to, at most, about 5 times the dry weight of the textiles to be laundered. The quantities of wash liquor are applied to the textiles during the wash step. It is essential that the wash liquor be substantially evenly and completely distributed onto the textiles. In the final step or steps of the process the textiles are rinsed with water to remove both the soil and detergent composition.

The quantities of wash liquor that can be used in the wash step range from, at least, about just enough to be substantially evenly and completely distributed onto all portions of the textiles to, at most, about 5 times the dry weight of the textiles to be laundered. The quantities of wash liquor in the range of the lower limit approach what is equivalent to directly applying a conventional level of a typical commercially available heavy duty liquid detergent composition to the textiles. Surprisingly, the addition of more wash liquor, i.e., adding both water and detergent composition to the wash liquor such that the wash liquor concentration remains constant, so that the upper limit is exceeded results in essentially no additional soil removal and no less soil redeposition. It should be noted that depending on the nature of the textiles, soil types, soil levels, detergent composition levels and detergent composition formulations that the upper limit can vary slightly. When quantities of wash liquor exceeding the absorption capacity of the textiles are utilized, only limited amounts of mechanical energy should be applied to the textiles during the wash step in order to prevent oversudsing. But, surprisingly, a good level of cleaning performance is achieved nonetheless. Also, with quantities of wash liquor exceeding the absorption capacity of the textiles, though possible, it is not essential that the preferred apparatus be utilized.

MOST PREFERRED QUANTITIES OF WASH LIQUOR

Therefore, in a more preferred embodiment the quantity of wash liquor that can be used in the wash step ranges from about just enough to be substantially evenly and completely distributed onto all portions of the textiles to, at most, none or minimal amounts of wash liquor in excess of the absorption capacity of the textiles. With such quantities there is at most minimal amounts of "free" wash liquor. Thus, essentially all of the wash liquor and, therefore, essentially of the detergent composition contained in the wash liquor, will be in intimate contact with the textiles throughout the wash step. This permits the application of a substantial amount of mechanical agitation to the textiles during the wash step, as discussed below, without any oversudsing.

Surprisingly, numerous other benefits are obtained when the quantities of wash liquor of this more preferred embodiment are utilized. For example, since essentially all of the detergent composition is in intimate contact with the textiles, the detergent composition is being utilized extremely efficiently. Also, there is essentially no wash liquor for the dye of the textiles to be released into and subsequently deposited onto another textile. Thus, dye transfer during the wash step is minimized and, therefore, it is generally not necessary for the consumer to presort the textiles. This is particularly significant if the laundry load contains the type of textile commonly known as a dye bleeder, i.e., one that contains excessive amounts of highly soluble dyes. Another benefit is that the addition of more wash liquor, i.e., adding both water and detergent compositions to the wash liquor such that the wash liquor concentration remains constant, to approach the upper limit of about 5 times the dry weight of the textiles to be laundered provides minimal additional soil removal in view of the cost of the additional detergent composition utilized.

In a more preferred embodiment, the quantity of wash liquor that can be used in the wash step is from about just enough to be substantially evenly and completely distributed onto the textiles to about 2½ times the dry weight of the textiles and preferably from about ¾ to about 1½ times the dry weight of the textiles. These ranges provide the most efficient use of a detergent composition. That is to say, in these ranges, for a given quantity of detergent composition, there is the most soil removal and least soil redeposition. Surprisingly, the addition of more water to the wash liquor, i.e., diluting the wash liquor, so as to exceed this upper limit, results in less soil removal from the textiles and more soil redeposition. Also, with this preferred limit, contact dyeing is minimized. Contact dyeing is the transfer of dye from the surface of one textile directly to that of another. These preferred ranges can also very depending on the nature of the textiles, soil types, soil levels, detergent composition levels and detergent composition formulations.

THE WASH LIQUOR

The wash liquor contains from about 40% to about 99.9%, preferably from about 85% to about 99.5% and most preferably from about 95% to about 98.7% of water and from about 1,000 ppm to about 600,000 ppm, preferably from about 5,000 ppm to about 150,000 ppm and most preferably from about 13,000 ppm to about 50,000 ppm of a detergent composition. Wash liquor concentrations of detergent composition below about 1,000 ppm result in substantially less soil removal from the textiles and above 600,000 ppm do not provide sufficient additional benefit to justify the addition of more detergent composition. However, in absolute terms, the wash liquor should contain from about five grams of detergent composition to about 200 grams per kilogram of wash load. As utilized herein the wash load refers to the dry weight of the textiles, unless otherwise specified. Preferably, the absolute amount of detergent composition in the wash liquor is from about 10 grams to about 60 grams per kilogram of wash load. However, the most preferable detergent composition levels are heavily dependent on the detergent composition formulation. It should be noted that the wash liquor of the present invention is much more concentrated than the wash liquor utilized in the conventional automatic home-type top loader washing machines, although similar quantities of detergent composition are used.

The detergent composition can contain all of the standard ingredients of detergent compositions, i.e., detergent surfactants and detergency builders. Suitable ingredients include those set forth in U.S. Pat. Nos. 3,936,537, Baskerville et al, Feb. 3, 1976; 3,664,961, Norris, May 23, 1972; 3,919,678, Laughlin et al, Dec. 30, 1975; 4,222,905, Cockrell, Sept. 16, 1980; and 4,239,659, Murphy, Dec. 16, 1980, all of which are incorporated herein by reference.

The wash liquor should preferably contain from about 400 ppm to about 150,000 ppm, more preferably from about 1,500 ppm to about 10,000 ppm of detergent surfactant and, in absolute terms, preferably from about 1 gram to about 45 grams per kilogram of wash load. The wash liquor should also contain preferably from 0 ppm to about 100,000 ppm, more preferably from 1,000 ppm to about 50,000 ppm of a detergency builder and, in absolute terms, preferably from about 10 grams to about 50 grams per kilogram of washload. It should be noted that another benefit of the concentrated laundering process is that, due to the small quantities of water utilized, water hardness control is not as critical as in a conventional wash process. Suitable detergent surfactants and detergency builders for use herein are disclosed in the U.S. patents cited immediately hereinbefore. The wash liquor can also contain inorganic salts other than detergency builders, enzymes and bleaches. The level of inorganic salts in the wash liquor is from about 0 ppm to about 150,000 ppm and preferably from about 1,500 ppm to about 50,000 ppm. The preferred enzymes for use herein are selected from the group consisting of proteases, amylases and mixtures thereof. The level of enzymes present in the wash liquor is from 0 ppm to about 3,000 ppm, preferably from 0 ppm to about 1,500 ppm. The level of proteases present in the wash liquor is from 0 Anson Units per liter (A.U./L.) to about 1.0 A.U./L. and preferably from 0.03 A.U./L. to about 0.7 A.U./L. The level of amylases present in the wash liquor is from about 0 Amylase Units/liter of wash liquor to about 26,000 Amylase Units/liter of wash liquor and preferably from about 200 Amylase Units/-liter of wash liquor to about 13,000 Amylase Units/liter of wash liquor wherein Amylase Units are as defined in U.K. Pat. No. 1,275,301 Desforges (Published May 24, 1972), incorporated herein by reference. Bleach levels in the wash liquor are from 0 ppm to about 6,000 ppm and preferably from about 500 ppm to about 2,000 ppm. Also, bleach levels in the wash liquor are from 0 ppm to about 2,000 ppm, preferably from about 20 ppm to about 1,000 ppm and most preferably from about 50 ppm to about 750 ppm of available chlorine when a chlorine bleach is utilized and from about 0 ppm to about 1,500 ppm, preferably from about 50 ppm to about 750 ppm and most preferably from about 100 ppm to about 500 ppm when an oxygen bleach is utilized.

Other parameters of the wash liquor are pH, viscosity, oil/water interfacial tension and particle size. The pH range for the wash liquor is from about 5 to about 12, preferably from about 7 to about 10.5 and most preferably from about 9 to about 10.5. It has been generally observed that superior cleaning can be achieved in the concentrated laundering process without the use of highly alkaline detergent compositions. The viscosity of the wash liquor can range preferably from about the viscosity of water to about 250 centipoise and more preferably from about the viscosity of water to about 50 centipoise. Also, it is preferred that the oil/water interfacial tension is no greater than about 10 dynes and more preferably no greater than about 5 dynes and preferably that no solid ingredient is larger than about 50 microns and more preferably no larger than about 10 microns. Typically, the quantity of wash liquor utilized in the concentrated laundering process when utilized for home-type laundry loads will range from about 1 liter to about 20 liters and preferably from about 2 liters to about 5 liters.

The detergent compositions utilized in the concentrated laundering process can be in any form, such as granules, pastes, gels or liquids. However, based upon ease of preparation of the wash liquor, liquid detergent compositions and rapidly dissolving granular detergent compositions are desirable.

The conditions and detergent compositions for the present concentrated laundering process can be mild and safe for the most delicate fabrics cleaned by the least experienced consumer without unduly sacrificing cleaning.

WASH LIQUOR APPLICATION STEP

The wash liquor for the present process can be prepared by mixing the detergent composition and water. In the case of granular detergent compositions, the granules must be dissolved and/or dispersed before the resulting wash liquor can be applied to the textiles. In the illustrated embodiment, such predissolution and/or predispersion occurs by placing a predetermined quantity of granules in wash liquor reservoir 89 which is then filled from the water supply line 80 via control valve 82 and delivery line 96. If a highly concentrated liquid detergent composition is used, then a flow-through mixing cell, e.g., a static mixer, can be used as an alternative to the wash liquor reservoir to mix the detergent composition and water. However, in ranges of the minimal quantity of water, an appropriate concentrated aqueous liquid detergent composition can be applied "as is" without further dilution.

The wash liquor is applied as an aqueous liquid directly onto the textiles. Preferably, the textiles are dry when the wash liquor is applied. It is also desirable that the application of the wash liquor, especially when there is no free wash liquor, is such that it is substantially completely and evenly distributed onto the textiles. That is to say, that if the wash liquor is not evenly distributed over substantially all of the textiles, then the untreated portions will not be cleaned as well and/or those portions of the textiles which are treated with more than their proportionate share of the wash liquor which appear as "clean" spots after the concentrated laundering process has been carried out. It should be noted that with the larger quantities of wash liquor within the invention it is easier to make such a distribution. This is especially true with quantities of wash liquor exceeding the absorption capacity of the textiles.

The foregoing detailed description of a preferred machine embodiment to accomplish such an application where there is no free wash liquor will be used in the following discussion.

In a home-type front loading automatic washing machine of the type described hereinbefore and illustrated in FIGS. 1–5, the wash liquor is pumped from either the wash liquor reservoir 89 or mixing cell (not shown) through a delivery line 95 which has a high pressure spray nozzle 100 attached at the end of it. The nozzle should be situated inside of the machine in such a position so as to optimize the even and complete application of the wash liquor onto the textiles. This can be accomplished by attaching the nozzle 100 in the tubular shaped extension 19 of the stationary drum 15, as generally shown in FIG. 1. As an option, more than one nozzle can be used. Such multiple nozzles may be positioned so they will effectively increase the area of the drum that would be sprayed by the nozzles and, therefore, ensure a more complete application of the wash liquor onto the textiles. As an alternative to a nozzle, an atomizer (not shown) can be used. An atomizer is believed to be particularly desirable when minimal quantities of water are used because the wash liquor must be extremely finely divided to ensure uniform distribution. It should be noted that with quantities of wash liquor exceeding the absorption capacity of the textiles, but within the invention, less sophisticated means may be utilized to ensure good distribution of the wash liquor onto the textiles.

As generally described in the foregoing apparatus description before the wash liquor is pumped through the delivery line 95 and out the nozzle 100, the nozzle drum 40 is preferably rotated. The purpose of the rotation is to clear the textiles from the center of the drum so that they are not blocking the field of spray of the nozzle 100, to distribute them substantially uniformly along the peripheral wall 40, and to expose as much of their surface area to the initial spray as is feasible. This is preferably accomplished by initially driving movable drum 40 via concentrically mounted driven pulley 34 at a constant speed which is sufficient to force the textiles against the peripheral wall 41 of the movable drum 40 and thereafter driving movable drum 40 via eccentrically mounted driven pulley 28 at a reduced varying speed which allows the textiles to tumble continuously through the spray.

The pressure in the delivery line 95 should be high enough to produce a substantially flat fan-shaped spray of the wash liquor 230 through the nozzle 100, said spray preferably covering the entire depth of the movable drum 40, as generally shown in FIG. 3.

This particularly preferred method of wash liquor application permits the textiles to be substantially completely and evenly contacted by the wash liquor. This permits the very effective detergent/soil interaction of the concentrated laundering process to occur. Additionally, such a method of wash liquor application is extremely efficient because when the quantity of wash liquor utilized does not exceed the absorption capacity of the textiles essentially all of the wash liquor is on the textiles.

A benefit of the concentrated laundering process is that effective cleaning results can be obtained over a wide range of wash liquor temperatures. The temperature of the wash liquor can range from about 2° C. to about 90° C., preferably from about 15° C. to about 70° C. and most preferably from about 25° C. to about 50° C. Surprisingly, the cleaning performance achieved at temperatures from about 25° C. to about 50° C. is as good as that achieved at temperatures above about 50° C. Also, such low temperatures are especially safe for dyed and/or synthetic textiles. Dye transfer is minimized at such temperature, especially when there is no free wash liquor. If it is desired to perform the wash liquor application step at temperatures above ambient temperature, either the wash liquor or the incoming water from supply line 80 can be heated before the wash liquor is applied to the textiles. However, it is preferred that the temperature of the textiles not exceed about 70° C., as this may result in excessive wrinkling and shrinkage. Furthermore, temperature-sensitive synthetic textiles should not be heated above their manufacturer-recommended washing temperatures.

APPLICATION OF ENERGY AFTER TEXTILES HAVE BEEN CONTACTED WITH WASH LIQUOR

In a preferred embodiment, energy can be applied to the textiles after they have been contacted by the wash liquor. It may be in the form of heat energy and/or mechanical energy, albeit they are not completely interchangeable, for a period ranging from about 1 to about 30 minutes, preferably from about 5 to about 15 minutes.

The application of heat energy permits the consumer to obtain excellent bleaching performance from bleaches such as sodium perborate, sodium percarbonate and hydrogen peroxide which are generally more effective at higher temperatures. This is not economical in a conventional home-type automatic wash process due to the cost of heating such large quantities of wash liquor. Further, since small quantities of water are used in the concentrated laundering process, conventional levels of bleach will have a higher effective concentration. This too contributes to the effective and/or efficient use of bleach in the concentrated laundering process.

In a preferred embodiment, heat energy is applied by recirculating moist air which is heated via heating element 165 to raise the temperature of the textiles to about 60° C., the temperature at which hydrogen peroxide based bleaches become particularly reactive. In addition to the closed loop moist air recirculation system disclosed in FIG. 1, numerous other methods may be used for the application of heat energy. Nonlimiting examples are microwaves, steam and solar energy.

As an alternative to the application of heat energy to activate the bleach, inorganic peroxide salt activators or low temperature active bleaches such as peroxyacids can be used. Such activated bleaches are effective below about 50° C. Organic peroxide salt activators are well known in the art and are described extensively in the literature. For example, see U.S. Pat. Nos. 4,248,928, Spandini et al, issued Feb. 3, 1981, and 4,220,562, Spadini et al, issued Sept. 12, 1980, which are hereby incorporated herein by reference. Active bleaches such as organic peroxyacids and water soluble salts thereof are well known in the art. For a more detailed description of such bleaches see U.S. Pat. Nos. 4,126,573, Johnson, issued Nov. 21, 1978 and 4,100,095, Hutchins et al, issued June 11, 1978, both patents being hereby incorporated herein by reference.

Other benefits of the application of heat energy are the assistance in the distribution of wash liquor onto the textiles and lipid/oily soil removal. If during the wash liquor application step the wash liquor was not substantially evenly and completely distributed onto the textiles, then the application of heat energy does provide some additional distribution. Also, experimental evidence indicates that heat energy does assist somewhat in the removal of lipid/oily soil. Some other potential benefits of the application of heat energy are the effective use of enzymes and the creation of desirable detergent surfactant phases. Different enzymes are most effective at different temperatures. Therefore, the textiles could be heated through certain temperature ranges to maximize enzyme effectiveness. However, as discussed hereinbefore, heat energy does not provide a major performance benefit, except as discussed hereinbefore with respect to bleaches, to the concentrated laundering process. It is preferred that heat energy be applied such that the temperature of the textiles is preferably from about 15° C. to about 70° C. and more preferably from about 25° C. to about 50° C.

The application of mechanical energy provides numerous benefits. Mechanical energy helps to distribute the wash liquor so that it is more evenly and completely distributed onto the textiles. Thus, if during the wash liquor application step the wash liquor was not substantially evenly and completely distributed onto the textiles, then the input of mechanical energy will enhance such distribution. Mechanical energy also minimizes the period of time that the same textiles will remain in intimate contact with each other. Consequently, contact dyeing is minimized. Also, it is believed that mechanical energy contributes to improved cleaning efficacy. However, with quantities of wash liquor exceeding the absorption capacity of the textiles, only a limited amount of mechanical energy should be applied in order to prevent oversudsing. But, this is dependent on the concentration and nature of the detergent composition in the wash liquor.

In the embodiment illustrated in FIGS. 1–5, mechanical energy can be applied by continuing rotation of the movable drum 40 at the last speed at which the wash liquor was applied. This creates a tumbling action by the textiles in movable drum 40 and results in the textiles being mechanically agitated.

THE RINSE

After the foregoing steps have been completed, the textiles are rinsed in a rinse liquor which preferably comprises clear water. Unlike a conventional automatic wash process wherein the goal of the rinse is to remove primarily the residual detergent composition, the goal of the present rinse is to remove the entire detergent composition and the soil. Thus, the present rinse step simultaneously performs the soil and detergent composition transport functions normally performed sequentially in conventional washing and conventional rinsing steps. Surprisingly, it has been observed that, during the rinse step, soil redeposition and dye transfer are minimal. Also, it has been observed that the rinse liquor contains stable emulsion particles whereas the rinse liquor in a conventional automatic wash process does not contain such emulsion particles.

In the preferred laundering apparatus illustrated in FIGS. 1–5, rinse liquor is introduced to the interior of movable drum 40 from water supply line 80 via control valve 83, delivery line 110 and applicator nozzle 120. Movable drum 40 is preferably rotated at varying speed via eccentrically mounted driven pulley 28 so that the textiles being rinsed are caused to tumble in a manner similar to the wash liquor application step. For more complete agitation of the articles being rinsed movable drum 40 may be stopped and its direction of rotation reversed several times throughout the rinse cycle. After the initial rinse has been completed, the rinse liquor is preferably removed from movable drum 40 by pumping it out via pump 140 without accelerating the rotation of the movable drum. This procedure can be repeated several times until the detergent composition and soil are removed. However, the textiles need not be spun out by high speed rotation of movable drum 40 between rinses. This minimizes the potential for wrinkling if the textiles are warm and also minimizes the potential for soil redeposition due to the rinse water being "filtered" through the textiles. If desired, adjuvants such as optical brighteners, fabric softeners and perfumes can be added to the rinse or applied, via the applicator nozzle 120, after the last rinse and distributed by tumbling. Bodying agents, such as starch, can also be added by spraying after the last rinse. Following the last rinse the textiles can be spun out by high speed rotation of movable drum 40.

An effective rinse can be accomplished in accordance with the present invention with reduced water consumption and, therefore, if heated water is used, reduced energy consumption. The amount of rinse liquor per kilogram of wash load is from about 4 liters to about 32 liters, preferably from about 5 liters to about 10 liters per rinse cycle. Rinse liquor levels below this amount would not produce enough free water on the surface of the textiles to adequately suspend the soil and detergent composition. Generally more than one rinse cycle is necessary to remove all of the soil and detergent composition from the textiles. The use of such small quantities of rinse liquor permits the consumer to perform an entire laundering cycle of the present invention with about 25 liters or less of water per kilogram of wash load. The rinse liquor temperature is from about 15° C. to about 5° C. and preferably from about 25° C. to about 45° C.

In a particularly preferred embodiment of the present invention carried out in the apparatus of FIGS. 1–5, the complete rinse comprises two or three cycles which can be carried out in either cold or warm clear water. Each cycle can be from about 1 to about 10 minutes with each cycle not necessarily being the same length of time.

In a particularly preferred embodiment of the present invention, the weight of the dry wash load is determined by an automatic weight sensor (not shown) and the qauntities of wash liquor, detergent composition, and rinse liquor are automatically regulated thereafter by control means known in the art and therefore not shown.

After the final rinsing step the laundered textiles can, if desired, be dried in the apparatus illustrated in FIGS. 1–5. This is done by positioning diverter valve 168 so that atmospheric air is drawn into connecting duct 171 by blower 160, heated by heating element 165, circulated through the tumbling textiles contained in the moving drum 40, withdrawn from drum 40 in a humid condition via connecting duct 167 and vented to atmosphere via connecting duct 170. Exercising this option enables the consumer to perform the entire laundering and drying process in a single apparatus and in continuous fashion.

The present concentrated laundering process can be employed to clean up even the dingiest of textiles and especially synthetic textiles in a number of laundering cycles. When an effective bleach is employed, the number of laundering cycles required for such purposes is reduced. This is believed to be due to the combination of excellent soil removal and substantial avoidance of excessive dye transfer and soil redeposition. Also, it has been observed that the present concentrated laundering process extends the useful "life" of textiles. This is believed to be due to the wash liquor lubricating the textile fibers.

Another aspect of the present invention is a granular paste, gel or liquid detergent composition packaged in association with instructions for use in the concentrated laundering process. When such detergent composition is combined with water it produces from just enough wash liquor to be substantially evenly and completely distributed onto a wash load of textiles to about 5 kilograms of a wash liquor per kilogram of wash load of textiles, said wash liquor containing from about 10 grams to about 60 grams of the detergent composition per kilogram of wash load of textiles.

The process of this invention is primarily directed to household laundry which consists of wash loads essentially made up of textiles, i.e., the process is a small batch process, that typically cleans less than about 10 kilograms of soiled textiles which are a mixture of textile types and/or colors. While the present concentrated laundry process has been described in detail in conjunction with a preferred home laundering apparatus, it will be appreciated by those skilled in the art that the process can also be carried out on an industrial scale if provision is made for proper distribution of the wash liquor over the textiles and avoidance of appreciable amounts of free wash liquor in contact with the textiles.

The following examples are illustrative of the invention.

EXAMPLE 1

Three sets of polyester and polycotton swatches containing the following soil types were prepared: artificial sebum, triolein, CRISCO oil and a mixture of inorganic particulate soil and lipid soil. The three sets of swatches, with three clean swatches used to measure soil redeposition, were then sprayed with wash liquor containing 1.92 grams of ARIEL (a commercial detergent composition containing about 10% surfactant, about 45% sodium tripolyphosphate detergency builder, about 12% sodium perborate bleach, and about ¼% of an enzyme composition) in a miniature laundering apparatus which mimics the action of the exemplary laundering apparatus disclosed in the preferred apparatus description. This quantity of ARIEL corresponds to about 32 grams of detergent composition per kilogram of wash load. The movable drum in the miniature laundering apparatus has a nine inch diameter and a nine inch depth. The swatches were then mechanically agitated at room temperature for seven minutes by rotating the movable drum. The swatches were then rinsed in another miniature laundering apparatus having a six inch diameter and four inch depth movable drum with 0.462 liters tap water for two minutes. (The size of the movable drum used for the rinse was selected to be proportional to the textile load although the size of the movable drum used for the wash liquor application was larger because spray-on was not feasible in the small six-inch drum.) The rinse step was performed three times. The above procedure was repeated with wash liquors comprising various quantities of water and 1.92 grams of ARIEL. The swatches were then measured to obtain the difference in Hunter Whiteness Units Filtered (ΔHWUF). This measurement corresponds to the amount of soil removed from the swatches, with the higher number signifying greater soil removal. HWUF measurements exclude the effect of brightener, thereby measuring only soil removal. The results were as follows:

| | ΔHWUF Weight ratio of wash liquor to swatches | | |
|---|---|---|---|
| | 1:1 | 2.5:1 | 3.5:1 |
| Artificial sebum polyester | 9.4 | 6.9 | 4.6 |
| Artificial sebum polycotton | 20.1 | 14.7 | 12.0 |
| CRISCO polyester | 6.1 | 3.7 | 2.5 |
| CRISCO polycotton | 8.7 | 6.2 | .9 |
| Triolein polyester | 8.9 | 5.1 | 5.3 |
| Triolein polycotton | 16.3 | 6.6 | 6.4 |
| Soiled polyester | 27.4 | 20.5 | 12.0 |
| Soiled polycotton | 33.1 | 28.8 | 19.4 |
| Polyester redeposition | −9.0 | −11.5 | −17.2 |
| Polycotton redeposition | −2.7 | −4.0 | −7.3 |

The data indicate that as the quantity of water in the wash liquor is increased above the wash liquor to swatches ratio of about 2.5:1, there is less soil removal and more soil redeposition.

EXAMPLE II

A washload was prepared in the miniature laundering apparatus of Example I consisting of the following textiles: 20 3½"×3½" white polycotton swatches, 15 4"×4" white polyester swatches, four 6"×6" white terry cloth towels. One 6"×6" red terry cloth towel, which is an excessive dye bleeder, was used as a dye source. The dry weight of the textiles was as follows:

| | Dry weight of textiles (Grams) |
|---|---|
| 4 white terries | 36 |
| 1 red terry | ~9 |
| 15 white polyester swatches | 32.2 |
| 20 white polycotton swatches | 26.4 |
| Total | ~103.6 |

The wash liquor was prepared by dissolving 3.3 grams of ARIEL in 200 ml. of tap water. The movable drum was then rotated and the wash liquor was sprayed onto the textiles until contact dyeing was first visually observed. The weight of the wash liquor absorbed onto the textiles was calculated. The results were as follows:

| | Weight of wet textiles (grams) | Weight of wash liquor absorbed by textiles (grams) |
|---|---|---|
| 4 white terries | 108.3 | 72.3 |
| 1 red terry | ~27.1 | ~18.1 |
| 15 white polyester swatches | 82.2 | 50.0 |
| 20 white polycotton swatches | 50.8 | 24.4 |
| Total | ~268.8 | ~165.2 |

Then the ratio of the weight of wash liquor absorbed by the textiles to the dry weight of the textiles was calculated.

| | Ratio of weight of wash liquor absorbed to dry weight of textiles |
|---|---|
| 4 white terries | 2.0 |
| 1 red terry | ~2.0 |
| 15 white polyester swatches | 1.6 |
| 20 white polycottons | .9 |
| Total | ~1.6 |

These data indicate that when excessive dye bleeders are included in a typical wash load, contact dyeing occurs when the weight of the wash liquor exceeds about 1½ times the total weight of the textiles.

EXAMPLE III

Two sets of cotton swatches were prepared with each swatch containing of the following four stains: brown gravy, cofee, grape and tea. Two sets of polyester and polycotton swatches were prepared with each swatch containing one of the following soil types: artificial sebum, artificial sebum plus particulate soil and triolein. Then 24 dingy swatches were prepared in which half were made from a cotton T-shirt and half were made from a polycotton sheet. All of the above swatches were pinned to two cotton towels for a combined weight of ½ pound. A 5½ pound "dummy" load consisting of clean temperature-sensitive synthetic textiles and the swatches were placed in an apparatus similar to that shown in FIG. 1. The textiles were then rotated and a wash liquor consisting of 96 grams of ARIEL dissolved in 2.84 liters of tap water which was sprayed onto the textiles. The textiles were then rotated at room temperature for 10 minutes and then subsequently rinsed in about 20 liters of water. The rinse step was repeated twice. The above procedure was repeated three more times with only the temperature of the wash load during the 10 minute rotation period being varied.

The data were obtained in ×E units and ΔHWUF units. ΔE units are a measurement of the change in color of the swatch resulting from the wash cycle. Change in color is proportional to the amount of soil removal, with a higher ΔE value corresponding to greater soil removal. The above procedure was repeated and the average of the results of the two replicates is as follows:

| | 45* | Rm | 120 | 150 | 180 |
|---|---|---|---|---|---|
| | (Temperature °F.) | | | | |
| | (7.2° C.) | | (49° C.) | (65.5° C.) | (82.2° C.) |
| | ΔE | | | | |
| Brown gravy | 2.2 | 4.9 | 4.9 | 8.6 | 7.6 |
| Coffee | 3.8 | 5.8 | 6.5 | 6.2 | 6.3 |

-continued

| | 45* | Rm | 120 | 150 | 180 |
|---|---|---|---|---|---|
| | (Temperature °F.) | | | | |
| | (7.2° C.) | | (49° C.) | (65.5° C.) | (82.2° C.) |
| Grape | 3.1 | 6.4 | 7.9 | 10.6 | 10.6 |
| Tea | 2.0 | 5.5 | 7.2 | 8.9 | 8.4 |
| Artificial sebum polyester | 6.4 | 13.1 | 11.4 | 14.6 | 12.4 |
| Artificial sebum polycotton | 6.5 | 11.2 | 11.0 | 10.6 | 10.3 |
| Triolein polyester | 4.7 | 5.0 | 7.0 | 6.0 | 7.3 |
| Triolein polycotton | 6.3 | 7.6 | 8.6 | 7.5 | 8.5 |
| | ΔHWUF | | | | |
| Soiled polyester | 27.3 | 42.9 | 43.9 | 44.1 | 40.3 |
| Soiled polycotton | 35.2 | 48.6 | 48.6 | 48.0 | 48.5 |

*Same laundry load as in Example V and only one replicate.

The data indicate that the concentrated laundering process is only slightly temperature dependent. Higher temperatures were significant for stain removal, but that is primarily due to the bleach in ARIEL which becomes more effective at higher temperatures.

It was visually observed that at temperatures of 150° F. (65.5° C.) and 180° F. (82.2° C.) that the sensitive synthetic textiles suffered much wrinkling and shrinkage. It is surprising that the level of cleaning at "cool" temperatures, e.g., less than about 40° C., is extremely good. Prior to this invention it was believed impossible to obtain this level of cleaning at these temperatures.

EXAMPLE IV

Twelve old dingy T-shirts and pillow cases were washed along with a family bundle according to the same procedure as outlined in Example III. The temperature of the wash load during the ten minute rotation period was 145° F. (62.8° C.). The T-shirts and pillowcases were used normally in between wash cycles. Hunter Whiteness Units were measured before and after the indicated number of wash cycles to obtain the difference in Hunter Whiteness Units (ΔHWU). The results were as follows:

| Pillowcase | ΔHWU | No. of wash cycles |
|---|---|---|
| 1 | 26.1 | 15 |
| 2 | 37.0 | 16 |
| 3 | 58.6 | 6 |
| 4 | 55.1 | 6 |
| 5 | 51.0 | 6 |
| 6 | 49.0 | 6 |
| 7 | 13.9 | 7 |
| 8 | 12.8 | 7 |
| 9 | 11.3 | 3 |
| 10 | 10.0 | 3 |
| 11 | 39.6 | 9 |
| 12 | 41.6 | 9 |
| **T-shirt** | **ΔHWU** | **No. of wash cycles** |
| 1 | 14.2 | 17 |
| 2 | 13.9 | 17 |
| 3 | 34.2 | 11 |
| 4 | 27.8 | 11 |
| 5 | 17.6 | 12 |
| 6 | 17.5 | 10 |
| 7 | 18.3 | 15 |
| 8 | 14.2 | 15 |
| 9 | 19.5 | 6 |
| 10 | 14.9 | 7 |
| 11 | 16.3 | 6 |
| 12 | 17.5 | 5 |

The data indicate that there was considerable soil removal from the pillowcases and T-shirts and their clean condition was maintained. This level of performance cannot be achieved with a conventional automatic wash process.

EXAMPLE V

A six pound wash load was prepared that consisted of a 5½ pound load of actual household laundry and ½ pound load made up of cotton, polyester, polycotton swatches pinned to two cotton towels. Each cotton swatch contained one of the following stains: brown gravy, coffee, grape and tea. Each polyester and polycotton swatch contained one of the following soils: artificial sebum, triolein and a mixture of inorganic particulate soil and lipid soil. The wash load was then washed according to the same procedure as outlined in Example III. The temperature of the wash load during the ten minute rotation period was about 145° F. (62.8° C.). The above procedure was repeated two more times with reduced quantities of ARIEL.

The above wash procedure was repeated with the following detergent compositions: TOP (a commercial detergent composition containing enzymes) and ZAB (a built commercial detergent composition containing enzymes). This procedure was also repeated with reduced quantities of detergent compositions.

The data were obtained in ΔE units and ΔHWUF units. The results were as follows:

| | ΔE ARIEL | | |
|---|---|---|---|
| | 96 | 48 | 24 |
| | (Grams of detergent) | | |
| Brown gravy | 14.5 | 7.0 | 5.0 |
| Coffee | 12.6 | 5.6 | 6.2 |
| Grape | 14.8 | 2.8 | 5.3 |
| Tea | 14.3 | 5.7 | 2.5 |
| Artificial sebum polyester | 9.0 | 8.0 | 3.9 |
| Artificial sebum polycotton | 8.2 | 6.9 | 4.3 |
| Triolein polyester | 7.6 | 5.3 | 3.8 |
| Triolein polycotton | 10.8 | 7.2 | 3.7 |
| | ΔHWUF | | |
| Soiled polyester | 40.2 | 17.2 | 4.0 |
| Soiled polycotton | 51.3 | 34.8 | 21.7 |

| | ΔE TOP | |
|---|---|---|
| | 96 | 48 |
| | (Grams of detergent) | |
| Brown gravy | 8.8 | 6.2 |
| Coffee | 8.1 | 5.1 |
| Grape | 7.8 | 2.3 |
| Tea | 4.4 | 2.9 |
| Artificial sebum polyester | 9.3 | 5.4 |
| Artificial sebum polycotton | 10.5 | 8.2 |
| Triolein polyester | 5.7 | 4.0 |
| Triolein polycotton | 10.5 | 8.2 |
| | ΔHWUF | |
| Soiled polyester | 38.3 | 21.0 |
| Soiled polycotton | 43.7 | 34.2 |

| | ΔE ZAB | |
|---|---|---|
| | 96 | 48 |
| | (Grams of detergent composition) | |
| Brown gravy | 9.6 | 6.1 |
| Coffee | 8.4 | 5.3 |
| Grape | 5.8 | 2.1 |
| Tea | 5.2 | 2.7 |
| Artificial sebum polyester | 6.2 | 4.0 |
| Artificial sebum polycotton | 7.7 | 4.2 |
| Triolein polyester | 8.3 | 4.1 |
| Triolein polycotton | 10.2 | 6.7 |
| | ΔHWUF | |

-continued

| | | |
|---|---|---|
| Soiled polyester | 34.7 | 19.8 |
| Soiled polycotton | 41.3 | 30.9 |

The data indicate that as the quantity of detergent in the wash liquor is reduced, the amount of soil removal from the swatches was also reduced.

EXAMPLE VI

The following typical granular detergent composition was prepared:

| | % |
|---|---|
| Sodium $C_{16-18}$ alkyl sulfate | 5.5 |
| Sodium $C_{12}$ linear alkylbenzene sulfonate | 3.5 |
| $C_{14-16}$ alkyl polyethoxylate | 5.5 |
| Sodium tripolyphosphate | 24.4 |
| Zeolite A | 17.6 |
| Sodium carbonate | 10.5 |
| Sodium silicate (2.0 r) | 1.9 |
| Sodium sulfate | 21.0 |
| Water | 8.9 |
| Miscellaneous | 1.2 |

Two sets of polyester and polycotton swatches containing the following soil types were prepared: artificial sebum, triolein, CRISCO oil, beef tallow and a mixture of inorganic particulate soil and lipid soil. The two sets of swatches, with two clean polyester swatches and two clean polycotton swatches used to measure soil redeposition, and 14 polyester and 15 polycotton clean swatches which constitute a "dummy" load were then placed in a miniature laundering apparatus which mimics the action of the exemplary laundering apparatus disclosed in the preferred apparatus description. The swatches were then sprayed with wash liquor containing 2.29 grams of the above granular detergent composition. The quantity of wash liquor corresponded to about twice the dry weight of all of the swatches and the quantity of detergent composition corresponded to about 17.6 grams per kilogram of swatches. The movable drum in the miniature laundering apparatus has a nine inch diameter and a nine inch depth. The swatches were then mechanically agitated at room temperature for ten minutes by rotating the movable drum. The swatches were then rinsed in one liter of tap water for two minutes and then dried in a conventional automatic dryer. This procedure was repeated three times. The ΔHWUF was calculated.

The above procedure was repeated with increased quantities of wash liquor, but constant wash liquor concentration. However, with weight ratios of wash liquor to swatches of 5 and 7, the movable drum was rotated gently during the ten minute mechanical agitation period so as to prevent oversudsing. The results were as follows:

| | Weight Ratio of Wash Liquor to Dry Swatches | ΔHWUF | Breakout* | | |
|---|---|---|---|---|---|
| Artificial sebum polyester | 2 | 15.51 | | B | C |
| | 3 | 14.24 | | | C |
| | 5 | 16.93 | A | B | |
| | 7 | 17.47 | A | | |
| Artificial sebum polycotton | 2 | 12.42 | | B | |
| | 3 | 12.97 | | B | |
| | 5 | 16.22 | A | | |
| | 7 | 18.07 | A | | |
| CRISCO polyester | 2 | 8.53 | A | | |
| | 3 | 6.52 | A | | |
| | 5 | 8.01 | A | | |
| | 7 | 9.48 | A | | |
| CRISCO polycotton | 2 | 10.70 | | B | |
| | 3 | 10.36 | | B | |
| | 5 | 13.94 | A | | |
| | 7 | 15.57 | A | | |
| Triolein polyester | 2 | 12.41 | | B | |
| | 3 | 13.08 | | B | |
| | 5 | 15.58 | A | | |
| | 7 | 14.34 | A | B | |
| Triolein polycotton | 2 | 13.02 | | B | |
| | 3 | 13.24 | | B | |
| | 5 | 16.48 | A | | |
| | 7 | 18.30 | A | | |
| Beef tallow polyester | 2 | 10.84 | | B | |
| | 3 | 10.99 | | B | |
| | 5 | 14.12 | A | | |
| | 7 | 15.02 | A | | |
| Beef tallow polycotton | 2 | 9.41 | | B | |
| | 3 | 9.77 | | B | |
| | 5 | 13.99 | A | | |
| | 7 | 15.31 | A | | |
| Soiled polyester | 2 | 24.43 | | B | |
| | 3 | 25.40 | | B | |
| | 5 | 28.51 | A | | |
| | 7 | 29.99 | A | | |
| Soiled polycotton | 2 | 29.83 | | B | |
| | 3 | 32.25 | A | B | |
| | 5 | 35.97 | A | | |
| | 7 | 35.48 | A | | |
| Polyester redeposition | 2 | −1.21 | | B | |
| | 3 | −1.35 | | B | |
| | 5 | .49 | A | | |
| | 7 | .92 | A | | |
| Polycotton redeposition | 2 | −1.99 | | B | |
| | 3 | −1.97 | | B | |
| | 5 | −.93 | A | | |
| | 7 | −1.09 | A | B | |

*The Breakout was determined by an analysis of variance with the letters A, B and C representing a significant difference at a 95% confidence level. For example, with the artificial sebum polyester swatches there was a significant difference between the weight ratios of 2 and 7, 3 and 5, 3 and 7, but no significant difference between weight ratios of 2 and 3, 2 and 5 and 5 and 7.

These data indicate that as the weight ratio is increased from 5 to 7 there is no significant increase in soil removal, albeit 40% more detergent composition is applied to the swatches. Also, there appears to be not much increase in soil removal as the weight ratio is increased from 2 to 3 and, then, to 5 in view of the quantity of the increase of detergent composition applied to the textiles.

EXAMPLE VII

Base formulations were prepared containing

| | Parts |
|---|---|
| Sodium $C_{12}$ alkyl benzene sulfonate | 10. |
| Sodium tripolyphosphate | 30. |
| Sodium silicate (2.0 r) | 6.1 |
| Sodium sulfate | 53.9 |

The formulations were used to prepare wash solutions which were adjusted to the indicated pH's and the indicated grams of the indicated additives [A protease having a protease activity of 2 Anson Units (A.U.) per gram and sodium perborate tetrahydrate] were added. The wash solutions contained approximately 100 grams of product. For each composition, two wash solutions were prepared, one of three liters for the concentrated laundering process (CDLP) and one of 17 gallons for a conventional process (Conv.) in a conventional top loading washer. The concentrated laundering process was carried out in the machine of Example III. Six pounds of clothes and three stained swatches were in each load (grass stained for the enzyme runs, blueberry stained for the perborate run). The temperature in the enzyme runs was 120° F. and in the perborate runs it was 140° F. The differences in unfiltered readings from before the wash until after the wash (ΔE's) for the three swatches were read on a Hunter Color Difference Meter and averaged. These values were reported for the enzymes. For the perborate the value reported is the improvement over the control (ΔE−ΔE control) with no perborate [Δ(ΔE)'s].

| | | | | | |
|---|---|---|---|---|---|
| pH 10.0 | | | | | |
| gms. | 0. | 0.1 | 0.2 | 0.3 | 0.4 |
| ΔE's – CDLP | 14.0 | 15.7 | 19.6 | 17.8 | 17.6 |
| ΔE's – Conv. | 20.8 | 21.3 | 21.4 | 18.3 | 18.8 |
| pH 9.0 | | | | | |
| gms. | 0.0 | 0.1 | 0.2 | 0.4 | |
| ΔE's – CDLP | 19.4 | 21.6 | 23.6 | 25.8 | |
| ΔE's – Conv. | 27.4 | 31.7 | 31.7 | 27.6 | |

As can be seen from the above, the enzyme provides little, if any, improvement in the conventional process at these low absolute levels, whereas it consistently provides a substantial benefit in the concentrated process.

| | | | | | |
|---|---|---|---|---|---|
| Sodium perborate tetrahydrate gms. | 0. | 2. | 3. | 4. | 6. |
| AVO gms. | 0. | 0.20 | 0.29 | 0.39 | 0.59 |
| Δ(ΔE) – CDLP | 0. | 1.68 | 3.42 | 5.41 | 5.98 |
| Δ(ΔE) – Conv. | 0. | −0.96 | 0.14 | −2.34 | −2.75 |

As can be seen, the perborate improved the performance of the concentrated process, but either hurt or did not help the performance of the conventional process. The ΔE's for the controls were 29.2 and 35.6 respectively.

Enzymes and bleaches provide a benefit at low levels which do not provide any substantial benefit in a conventional process. With better detergent compositions the benefit obtained from these low levels of ingredients is sometimes more difficult to observe.

While particular embodiments of the present invention have been illustrated and described, it will be obvious to those skilled in the art that various modifications can be made without departing from the spirit and scope of the invention. For example, the wash liquor can be applied to the textiles by a brush, rollers, a wash liquor permeable structure mounted on the inner surface of the movable drum to allow contact of the textiles with the wash liquor that passes through the permeable structure, a gravity feed system which allows the wash liquor to drop onto the moving textiles, or any other means which applies the required amount of wash liquor evenly and completely to the textiles; other detergent compositions can be substituted for the specific detergent compositions described herein, etc.

Another aspect of this invention is that the concentrated laundering process permits the effective use of detergent compositions comprising bleaches and enzymes at levels in such detergent compositions that would provide essentially no benefit when such detergent compositions are utilized at normal usage levels in conventional automatic wash processes. "Normal usage levels in conventional automatic processes" are generally (a) the use of 96 grams of detergent composition in 64 liters of water at 40° C. for the Unites States of America; (b) the use of 146 grams of detergent composition in 20 liters of water at 75° C. for Europe; and (c) the use of 40 grams of detergent composition in 30 liters of water at 25° C. for Japan.

The bleaches that can be utilized in the detergent compositions are peroxygen bleaching compounds capable of yielding hydrogen peroxide in an aqueous solution. These compounds are well known in the art and include hydrogen peroxide and the alkali metal peroxides, organic peroxide bleaching compounds such as urea peroxide, and inorganic persalt bleaching compounds, such as the alkali metal perborates, percarbonates, perphosphates, and the like. Mixtures of two or more such bleaching compounds can also be used, if desired. Preferred peroxygen bleaching compounds include sodium perborate, commercially available in the form of mono- and tetrahydrates, sodium carbonate peroxyhydrate, sodium pyrophosphate peroxyhydrate, urea peroxyhydrate, and sodium peroxide. The level of such bleaches in the detergent compositions is from 0.01% to about 0.5% and preferably from about 0.1% to about 0.5% of available oxygen.

Other bleaches that can be utilized are activated bleaches such as peracids or peroxygen bleaching compounds capable of yielding hydrogen peroxide in an aqueous solution plus a bleach activator that can react to generate a peracid. Such peracids and bleach activators are well known in the art. For example, see U.S. Pat. Nos. 4,126,573, Johnston (Nov. 21, 1978) and 4,100,095, Hutchins et al (June 11, 1978) which deal with peracids and U.S. Pat. Nos. 4,248,928, Spadini et al (Feb. 3, 1981) and 4,220,562, Spadini et al (Sept. 12, 1980), which deal with bleach activators, all of which are incorporated herein by reference. The preferred peracid is magnesium monoperoxy phthalate hexahydrate as disclosed in European Patent Application 0,027,693. The detergent compositions can contain from about 0.03% to about 0.3% and preferably from about 0.1% to about 0.25% of available oxygen that can potentially be generated by peracid.

As another alternative, the detergent compositions can contain a chlorine bleach. Chlorine bleaches are well known in the art. The preferred chlorine bleach is sodium dichlorocyanurate dihydrate. Other suitable chlorine bleaches are sodium and potassium dichlorocyanurates, dichlorocyanuric acid; 1,3-dichloro-5,5-dimethyl hydantoin; N,N'-dichlorobenzoylene urea; paratoluene sulfondichloroamide; trichloromelamine; N-chloroammeline; N-chlorosuccinimide; N,N'-dichloroazodicarbonamide; N-chloroacetyl urea; N,N'-dichlorobiuret; chlorinated dicyandiamide; sodium hypochlorite; calcium hypochlorite; and lithium hypochlorite. The detergent compositions contain from about 0.03% to about 1.2% and preferably from about 0.1% to about 0.6% of available chlorine.

The enzymes that can be utilized in the detergent compositions are protease, amylases and mixtures thereof. The level of proteases present in the detergent composition is from about 0.01 Anson Units (A.U.) per 100 grams to about 0.27 A.U. per 100 grams and preferably from about 0.06 A.U. per 100 grams to about 0.25

A.U. per 100 grams. The level of amylase present in the detergent composition is from about 150 Amylase Units per 100 grams of detergent composition to about 24,000 Amylase Units per 100 grams of detergent composition and preferably from about 1200 Amylase Units per 100 grams of detergent composition to about 6000 Amylase Units per 100 grams of detergent composition. Amylase Units are defined in U.K. Pat. No. 1,275,301 Desforges (published May 24, 1972).

The concentrated laundering process also permits the effective use of novel detergent compositions comprising other desirable auxiliary ingredients at levels that would provide essentially no consumer noticeable benefit at normal usage levels in conventional automatic wash processes. Such ingredients include optical brighteners, soil release agents, antistatic agents, dyes, perfumes, pH adjusting agents, detergency builders, antibacterial agents, antifungal agents, antitarnish and anticorrosion agents, etc. Preferably, these ingredients are used at levels in a detergent composition that provide no consumer noticeable benefit when the detergent composition is used in conventional automatic home-type washing machine processes at normal usage levels.

A "consumer noticeable benefit" is based upon a representative number of consumers, the benefit being such that it can be recognized by a majority of the consumers at the 95% confidence level. More preferably these ingredients are used at less than $\frac{1}{4}$ of the level at which a consumer benefit is seen, most preferably at less than $\frac{1}{2}$ of said level.

It is intended to cover in the appended claims all such modifications that are within the scope of this invention.

What is claimed is:

1. A granular, paste, gel or liquid detergent composition packaged in association with instructions for use in a process for laundering a discrete wash load of assorted soiled textiles, the instructions comprising:

(a) produce a quantity of concentrated aqueous wash liquor comprising from about 40% to about 99.9% water and from about 1000 ppm to about 600,000 ppm of the packaged detergent composition;

(b) distribute substantially evenly and completely onto said textiles in their substantially dry state a quantity of said wash liquor ranging from about just enough to distribute said wash liquor substantially evenly and completely onto said textiles to a quantity of said wash liquor which is about 5 times the dry weight of the textiles, said wash liquor containing from about 5 grams to about 200 grams of said detergent composition per kilogram of said textiles;

(c) allow said wash liquor to remain in contact with said soiled textiles for a period of time during which, if there is more than a minimal amount of free liquor in excess of the absorption capacity of said textiles, only limited amounts of mechanical energy are applied to said textiles so as to prevent oversudsing;

(d) rinse said textiles with a quantity of an aqueous liquid, rinse liquor sufficient to produce enough free water on the surface of said textiles to adequately suspend the soil and the detergent composition; and (e) separate said rinse liquor containing said wash liquor and said soil from said textiles.

* * * * *